US010851541B2

(12) United States Patent
Robinson

(10) Patent No.: US 10,851,541 B2
(45) Date of Patent: Dec. 1, 2020

(54) EXPANSION JOINT SEAL FOR SURFACE CONTACT WITH OFFSET RAIL

(71) Applicant: Schul International Co., LLC, Hudson, NH (US)

(72) Inventor: Steven R. Robinson, Windham, NH (US)

(73) Assignee: Schul International Co., LLC, Hudson, NH (US)

( * ) Notice: Subject to any disclaimer, the term of this patent is extended or adjusted under 35 U.S.C. 154(b) by 20 days.

(21) Appl. No.: 15/911,292

(22) Filed: Mar. 5, 2018

(65) Prior Publication Data

US 2019/0271150 A1 Sep. 5, 2019

(51) Int. Cl.

| | |
|---|---|
| ***E04B 1/68*** | (2006.01) |
| ***E01C 11/10*** | (2006.01) |
| ***E01C 11/12*** | (2006.01) |

(52) U.S. Cl.

CPC ..... *E04B 1/6801* (2013.01); *E01C 11/10* (2013.01); *E01C 11/12* (2013.01); *E04B 1/6804* (2013.01); *E04B 1/6812* (2013.01)

(58) Field of Classification Search

CPC .... E04B 1/6801; E04B 1/6804; E04B 1/6812; E01C 11/12; E01C 11/10

See application file for complete search history.

(56) References Cited

U.S. PATENT DOCUMENTS

| | | | |
|---|---|---|---|
| 945,914 | A | 4/1909 | Colwell |
| 1,371,727 | A | 3/1921 | Blickle |
| 2,544,532 | A | 3/1951 | Hill |
| 2,995,056 | A | 10/1960 | Knox |
| 3,262,894 | A | 7/1966 | Green |
| 3,334,557 | A | 8/1967 | Fitzgibbon |
| 3,449,879 | A | 6/1969 | Bloom |
| 3,455,850 | A | 7/1969 | Saunders |
| 3,492,250 | A | 1/1970 | Deyrup |
| 3,527,009 | A | 9/1970 | Nyquist |
| 3,712,188 | A | 1/1973 | Worson |
| 3,772,220 | A | 11/1973 | Porter et al. |
| 3,827,204 | A | 8/1974 | Walters |
| 3,883,475 | A | 5/1975 | Racky et al. |
| 4,018,539 | A | 4/1977 | Puccio |
| 4,058,947 | A | 11/1977 | Earle et al. |
| 4,134,875 | A | 1/1979 | Tapia |
| 4,181,711 | A | 1/1980 | Ohashi et al. |

(Continued)

FOREIGN PATENT DOCUMENTS

| | | |
|---|---|---|
| CA | 1280007 | 2/1991 |
| CA | 1334268 | 2/1995 |

(Continued)

OTHER PUBLICATIONS

Hai Vo; Non-Final Office Action for U.S. Appl. No. 15/189,671; dated Mar. 7, 2018; 17 pages; USPTO; Alexandria, Virginia.

(Continued)

*Primary Examiner* — Babajide A Demuren

(74) *Attorney, Agent, or Firm* — Crain, Caton & James, P.C.; James E. Hudson, III

(57) ABSTRACT

A system for creating a durable seal between adjacent panels, including those which may be subject to temperature expansion and contraction or mechanical shear having a cover plate, a rail, and an elastically-compressible core adjacent the rail.

23 Claims, 8 Drawing Sheets

(56) References Cited

U.S. PATENT DOCUMENTS 4,224,374 A 9/1980 Priest
4,237,182 A 12/1980 Fulmer et al.
4,260,688 A 4/1981 Simon
4,288,559 A 9/1981 Illger
4,374,207 A 2/1983 Stone et al.
4,401,716 A 8/1983 Tschudin-Mahrer
4,455,396 A 6/1984 Al-Tabaqchall et al.
4,565,550 A 1/1986 Dorer, Jr. et al.
4,566,242 A 1/1986 Dunsworth
4,654,550 A 3/1987 Lowther et al.
4,767,655 A 8/1988 Tschudin-Mahrer
4,839,223 A 6/1989 Tschudin-Mahrer
4,922,676 A 5/1990 Sproken
4,992,481 A 2/1991 von Bonin et al.
5,000,813 A 3/1991 Hill
5,006,564 A 4/1991 Noonenbruch et al.
5,007,765 A 4/1991 Deitlein et al.
5,130,176 A 7/1992 Baerveldt
5,173,515 A 12/1992 von Bonin
5,253,459 A 10/1993 Parinas et al.
5,327,693 A 7/1994 Schmid
5,335,466 A 8/1994 Langohr
5,502,937 A * 4/1996 Wilson ..... B32B 15/14 52/273
5,686,174 A 7/1997 Irrgeher
5,744,199 A 4/1998 Joffre et al.
5,765,332 A 6/1998 Landin et al.
5,935,695 A 8/1999 Baerveldt
6,039,503 A 3/2000 Cathey
6,418,688 B1 7/2002 Jones, Jr.
6,532,708 B1 3/2003 Baerveldt
6,544,445 B1 4/2003 Graf et al.
6,666,618 B1 12/2003 Anaya et al.
6,685,196 B1 2/2004 Baerveldt
6,698,146 B2 3/2004 Morgan et al.
6,928,777 B2 8/2005 Cordts
8,317,444 B1 11/2012 Hensley
8,341,908 B1 1/2013 Hensley et al.
8,365,495 B1 2/2013 Witherspoon
8,590,231 B2 11/2013 Pilz et al.
8,595,999 B1 12/2013 Pilz et al.
8,720,138 B2 5/2014 Hilburn, Jr.
8,739,495 B1 6/2014 Witherspoon
8,813,449 B1 8/2014 Hensley et al.
8,813,450 B1 8/2014 Hensley et al.
8,870,506 B2 10/2014 Hensley et al.
8,935,897 B2 1/2015 Shaw
9,045,899 B2 6/2015 Pilz et al.
9,068,297 B2 6/2015 Hensley et al.
9,200,437 B1 12/2015 Hensley et al.
9,206,596 B1 12/2015 Robinson
9,322,163 B1 4/2016 Hensley
9,404,581 B1 8/2016 Robinson
9,528,262 B2 12/2016 Witherspoon
9,631,362 B2 4/2017 Hensley et al.
9,637,915 B1 5/2017 Hensley et al.
9,644,368 B1 5/2017 Witherspoon
9,670,666 B1 6/2017 Witherspoon et al.
9,677,299 B2 6/2017 Whiteley
9,689,157 B1 6/2017 Hensley et al.
9,689,158 B1 6/2017 Hensley et al.
9,719,248 B1 8/2017 Meacham
9,732,853 B2 8/2017 Kethorn et al.
9,739,049 B1 8/2017 Robinson
9,739,050 B1 8/2017 Hensley et al.
9,745,738 B2 8/2017 Robinson
9,765,486 B1 9/2017 Robinson
9,803,357 B1 10/2017 Robinson
9,840,814 B2 12/2017 Robinson
9,850,662 B2 12/2017 Hensley
9,856,641 B2 1/2018 Robinson
9,915,038 B2 3/2018 Robinson
9,951,515 B2 5/2018 Robinson
9,963,872 B2 5/2018 Hensley et al.
9,982,428 B2 5/2018 Robinson
9,982,429 B2 5/2018 Robinson
9,995,036 B1 6/2018 Robinson
10,000,921 B1 6/2018 Robinson
10,017,939 B2 * 7/2018 Andresen ..... E04B 2/96
10,060,122 B2 8/2018 Robinson
10,066,386 B2 9/2018 Robinson
10,066,387 B2 9/2018 Hensley et al.
10,081,939 B1 9/2018 Robinson
10,087,619 B1 10/2018 Robinson
10,087,620 B1 10/2018 Robinson
10,087,621 B1 10/2018 Robinson
10,072,413 B2 11/2018 Hensley et al.
10,125,490 B2 11/2018 Robinson
10,179,993 B2 1/2019 Hensley et al.
10,203,035 B1 2/2019 Robinson
10,213,962 B2 2/2019 Robinson
10,227,734 B1 3/2019 Robinson
10,233,633 B2 3/2019 Robinson
10,240,302 B2 3/2019 Robinson
2003/0005657 A1 1/2003 Visser et al.
2003/0110723 A1 6/2003 Baerveldt
2004/0035075 A1 2/2004 Trout
2004/0093815 A1 5/2004 Cordts
2005/0034389 A1 2/2005 Boot
2005/0126848 A1 6/2005 Siavoshai
2006/0053710 A1 3/2006 Miller et al.
2006/0117692 A1 6/2006 Trout
2007/0059516 A1 3/2007 Vincent et al.
2008/0172967 A1 7/2008 Hilburn
2008/0268231 A1 10/2008 Deib
2010/0275539 A1 11/2010 Shaw
2010/0304078 A1 12/2010 Stol
2012/0022176 A1 1/2012 Stahl et al.
2012/0023846 A1 2/2012 Mattox et al.
2012/0117900 A1 5/2012 Shaw
2013/0055667 A1 3/2013 Beele
2014/0219719 A1 8/2014 Hensley et al.
2014/0360118 A1 12/2014 Hensley et al.
2015/0068139 A1 3/2015 Witherspoon
2015/0337530 A1 11/2015 Pilz et al.
2017/0130450 A1 5/2017 Witherspoon
2017/0159817 A1 6/2017 Robinson
2017/0191256 A1 7/2017 Robinson
2017/0226733 A1 8/2017 Hensley et al.
2017/0241132 A1 8/2017 Witherspoon
2017/0254027 A1 9/2017 Robinson
2017/0268222 A1 9/2017 Witherspoon et al.
2017/0292262 A1 10/2017 Hensley et al.
2017/0298618 A1 10/2017 Hensley et al.
2017/0314213 A1 11/2017 Robinson
2017/0314258 A1 11/2017 Robinson
2017/0342665 A1 11/2017 Robinson
2017/0342708 A1 11/2017 Hensley et al.
2017/0370094 A1 12/2017 Robinson
2018/0002868 A1 1/2018 Robinson
2018/0016784 A1 1/2018 Hensley et al.
2018/0038095 A1 2/2018 Robinson
2018/0106001 A1 4/2018 Robinson
2018/0106032 A1 4/2018 Robinson
2018/0119366 A1 5/2018 Robinson
2018/0142465 A1 5/2018 Robinson
2018/0148922 A1 5/2018 Robinson
2018/0163394 A1 6/2018 Robinson
2018/0171564 A1 6/2018 Robinson
2018/0171625 A1 6/2018 Robinson
2018/0202148 A1 7/2018 Hensley et al.
2018/0238048 A1 8/2018 Robinson
2018/0266103 A1 9/2018 Robinson
2018/0274228 A1 9/2018 Robinson
2018/0300490 A1 10/2018 Robinson
2018/0363292 A1 12/2018 Robinson
2018/0371746 A1 12/2018 Hensley et al.
2018/0371747 A1 12/2018 Hensley et al.
2019/0057215 A1 2/2019 Robinson
2019/0063608 A1 2/2019 Robinson et al.
2019/0071824 A1 3/2019 Robinson

(56) References Cited

U.S. PATENT DOCUMENTS

| | | | |
|---|---|---|---|
| 2019/0107201 | A1 | 4/2019 | Robinson |
| 2019/0108351 | A1 | 4/2019 | Robinson |

FOREIGN PATENT DOCUMENTS

| | | | |
|---|---|---|---|
| CA | 2296779 | | 11/2006 |
| DE | 1436280 | A1 | 2/1996 |
| DE | 102005054375 | A1 | 5/2007 |
| EP | 0942107 | A2 | 9/1999 |
| EP | 1118715 | B1 | 10/2004 |
| EP | 1540220 | | 3/2006 |
| EP | 1983119 | A1 | 4/2007 |
| GB | 977929 | | 12/1964 |
| GB | 1359734 | | 7/1974 |
| GB | 1495721 | | 12/1977 |
| GB | 1519795 | | 8/1978 |
| GB | 2251623 | A1 | 7/1992 |
| GB | 2359265 | A1 | 8/2001 |
| WO | 03006109 | | 1/2003 |
| WO | 2003066766 | A1 | 8/2003 |
| WO | 2007023118 | A2 | 3/2007 |
| WO | 2006127533 | A1 | 11/2009 |

OTHER PUBLICATIONS

UFP Technologies; Polyethylene Foam Material; Dated Jan. 8, 2012; retrieved from https://web.archive.org/web/20120108003656/http://www.ufpt.com:80/materials/foam/polyethylene-foam.html on Mar. 7, 2018; 1 page.
Stephan, Beth A; Non-Final Office Action for U.S. Appl. No. 15/884,553; dated Mar. 7, 2018; 7 pages; USPTO; Alexandria, Virginia.
Hai Vo; Final Office Action for U.S. Appl. No. 15/189,671; dated May 31, 2018; 14 pages; USPTO; Alexandria, Virginia.
Iso Chemie GmbH; Iso-Flame Kombi F120; Jul. 1, 2006; 2 pages.
IsoChemie; Technical Datasheet blocostop F-120; Jul. 26, 2002; 1 page.
Lester Hensley; Where's the Beef in Joint Sealants? Hybrids Hold the Key; Spring 2001; Applicator vol. 23 No. 2; 5 pages (alternative version available at http://www.emseal.com/InTheNews/2001HybridsConstructionCanada.pdf).
MM Systems; ejp Expansion Joints EIF; Nov. 16, 2007; 2 pages.
MM Systems; ejp Expansion Joints; Nov. 16, 2007; 2 pages.
MM Systems; MM ColorJoint/SIF Series; 3 pages; Jan. 14, 2007.
Norton Performance Plastics Corporation; Norseal V740FR; 1996; 2 pages.
PCT/US2005/036849 filed Oct. 4, 2005 by Emseal Corporation; 11 pages; published Mar. 1, 2007 by World Intellectual Property Organization as WO 2007/024246.
Promat; Promaseal FyreStrip Seals for Movement in Joints in Floors/Walls; Feb. 2006; 4 pages.
Promat; Promaseal Guide for linear gap seals and tire stopping systems; 20 pages; Jun. 2008.
Promat; Promaseal IBS Foam Strip Penetration Seals on Floors/Walls; Sep. 2004; 6 pages.
Promat; Promaseal IBS Safety Data Sheet; Jul. 25, 2007; 3 pages.
Salamander Industrial Products Inc.; Blocoband HF; Feb. 15, 1996; 1 page.
Schul International Co. LLC; Color Econoseal Technical Data; Nov. 18, 2005; 2 pages.
Schul International Co. LLC; Sealtite "B" Technical Data; Oct. 28, 2005; 2 pages.
Schul International Co. LLC; Sealtite Airstop AR; Apr. 2004; 1 page.
Schul International Co. LLC; Sealtite Airstop FR; Apr. 2007; 1 page.
Schul International Co. LLC; Sealtite Standard; May 9, 2007; 2 pages.
Schul International Co. LLC; Sealtite Technical Data; Oct. 28, 2005; 2 pages.
Schul International Co. LLC; Sealtite VP (600) Technical Data; 2002.
Schul International Co. LLC; Seismic Sealtite II Technical Data; Sep. 20, 2006; 2 pages.
Schul International Co. LLC; Seismic Sealtite Technical Data; Oct. 28, 2005; 2 pages.
Lee W. Young, Written Opinion of the International Searching Authority, PCT/US06/60096, USPTO, USA dated Oct. 23, 2007, 4 pages.
Schul International Inc.; Sealtite 50N Technical Data; 2002; 2 pages.
Schul International Inc.; Sealtite 50N Technical Data; Oct. 28, 2005; 2 pages.
Emseal's new Universal-90 expansion joints, Buildingtalk, Mar. 27, 2009, 2 pages, Pro-Talk Ltd.
Schul International Inc.; Sealtite VP; Oct. 28 2005; 2 pages.
Schul International Inc.; Sealtite; Jul. 25, 2008; 3 pages.
Sealant Waterproofing & Restoration Institute; Sealants: The Professionals' Guide p. 26; 1995; 3 pages.
Stein et al. "Chlorinated Paraffins as Effective Low Cost Flame Retardants for Polyethylene" Dover Chemical Company Feb. 2003, 9 pages.
Tremco illbruck B.V.; Cocoband 6069; Apr. 2007; 2 pages.
Tremco illbruck Limited; Alfacryl FR Intumescent Acrylic; Oct. 22, 2007; 2 pages.
Tremco illbruck Limited; Alfasil FR Oct. 22, 2007; 2 pages.
Tremco illbruck Limited; Compriband 600; Oct. 5, 2007; 2 pages.
Tremco illbruck Limited; Compriband Super FR; Dec. 4, 2007; 2 pages.
Tremco illbruck Limited; Technical Data Sheet Product Compriband Super FR; Oct. 18, 2004; 4 pages.
Tremco Illbruck Limited; Technical Data Sheet Product: Compriband Super; Sep. 29, 2004; 3 pages.
Tremco illbruck Limited; TechSpec Division Facade & Roofing Solutions; Mar. 2005; 10 pages.
Tremco illbruck; Alfas Bond; Apr. 13, 2007; 2 pages.
Tremco Illbruck; illmod 600; Jun. 2006; 2 pages.
Tremco illbruck; The Specification Product Range; Feb. 2007; 36 pages.
Tremco-illbruck Ltd.; Webbflex B1 PU Foam; Nov. 9, 2006; 2 pages.
Thomas Dunn, International Preliminary Report on Patentability—PCT/US06/60096, dated Oct. 21, 2008, 6 pages, USPTO, USA.
Underwriter Laboratories Inc.; UL 2079 Tests for Fire Resistance of Building Joint Systems; Jun. 30, 2008; 38 pages.
Underwriter Laboratories LLC; System No. WW-S-0007 Joint Systems; Dec. 5, 1997 pages.
Underwriters Laboratories; Fire-resistance ratings ANSI/UL 263; 2014; 24 pages.
Underwriters Laboratories; UL 263 Fire Tests of Building Construction and Materials; Apr. 4, 2003; 40 pages.
Lee W. Young, International Search Report, PCT/US06/60096, dated Oct. 23, 2007, 2 pages, USPTO, USA.
BEJS System, Mar. 2009, 2 pages, Emseal Joint Systems, Ltd., USA.
20H System Tech Data, Jun. 1997, 2 pages, Emseal Joint Systems, Ltd., USA.
Horizontal Colorseal Tech Data, Jun. 1997, 2 pages, Emseal Joint Systems, Ltd.
Emseal Acrylic Log Home Tape Installation Instructions, Jun. 2011, 1 page, Emseal Joint Systems, Ltd., retrieved on Mar. 30, 2016 from https://web.archive.org/web/20160330181621/http://www.emseal.com/Products- /Specialty/LogHome/AcrylicLogHome.sub.—Tapes.sub.--Install.sub.--X.pdf.
Emseal BEJS System—Bridge Expansion Joint System, May 26, 2010, 5 pages, Emseal Joint Systems, Ltd., retrieved on Mar. 30, 2016 from https://web.archive.org/web/20100526081854/http://www.emseal.com/products- /Infrastructure/BridgeJointSeals/BEJSBridgeJointSystem.htm.
Dow Corning 890-SL Self-Leveling Silicone Joint Sealant, 2005, 4 pages, USA.

(56) References Cited

OTHER PUBLICATIONS

Install Data—Horizontal Colorseal—with Epoxy Adhesive, Jun. 1997, 2 pages, Emseal Joint Systems, Ltd., USA.
Backerseal (Greyflex), Sep. 2001, 2 pages, Emseal Joint Systems, Ltd., USA.
Emseal Emshield DFR2 System DFR3 System Tech Data, May 2010, 4 pages, Emseal Joint Systems, Ltd., USA.
Seismic Colorseal by Emseal, Aug. 21, 2007, 4 pages, Emseal Corporation, USA.
Universal 90's, Aug. 4, 2009, 4 pages, Emseal Joint Systems, Ltd., USA.
Specified Technologies, Inc.; Product Data Sheet PEN200 Silicone Foam; 2003; 2 pages.
Specified Technologies, Inc.; Product Data Sheet SpecSeal Series ES Elastomeric Sealant; 2004; 4 pages.
Specified Technologies, Inc.; Product Data Sheet SpecSeal Series ES Elastomeric Sealant; 2000; 4 pages.
Specified Technologies, Inc.; Product Data Sheet PEN300 Silicone Foam; 2004; 4 pages.
Specified Technologies, Inc.; Firestop Submittal Package; 2004; 37 pages.
XHBN Joint Systems Data Sheet (retrieved Sep. 6, 2017 from http://database.ul.com/cgi-bin/XYV/template/LISEXT/1FRAME/showpage.html?name=XHBN.WW-D-0109&ccnshorttitle=Joint+Systems&objid=1082471571&cfgid=1073741824&version=versionless&parent_id=1073995560&seguence=1).
"Protecting the Foundation of Fire-safety" by Robert Berhinig, P.E. (IAEI News, Jul./Aug. 2002).
Hai Vo; Final Office Action for U.S. Appl. No. 14/630,125; dated May 13, 2016; 11 pages; USPTO; Alexandria, Virginia.
Hai Vo; Non-Final Office Action for U.S. Appl. No. 14/630,125; dated Feb. 8, 2016; 8 pages; USPTO; Alexandria, Virginia.
Hai Vo; Notice of Allowance for U.S. Appl. No. 14/630,125; dated Jun. 14, 2016; 12 pages; USPTO; Alexandria, Virginia.
Beth A. Stephan; Notice of Allowance for U.S. Appl. No. 14/643,031; dated Oct. 28, 2015; 8 pages; USPTO; Alexandria, Virginia.
Paola Agudelo; Final Office Action for U.S. Appl. No. 15/046,924; dated May 10, 2017; 13 pages; USPTO; Alexandria, Virginia.
Paola Agudelo; Non-Final Office Action for U.S. Appl. No. 15/046,924; dated Dec. 12, 2016; 12 pages; USPTO; Alexandria, Virginia.
Paola Agudelo; Notice of Allowance for U.S. Appl. No. 15/046,924; dated Jul. 6, 2017; 7 pages; USPTO; Alexandria, Virginia.
Gilbert Y. Lee; Notice of Allowance for U.S. Appl. No. 15/217,085; dated Sep. 13, 2017; 8 pages; USPTO; Alexandria, Virginia.
Paola Agudelo; Non-Final Office Action for U.S. Appl. No. 15/648,908; dated Oct. 4, 2017; 11 pages; USPTO; Alexandria, Virginia.
Paola Agudelo; Notice of Allowance for U.S. Appl. No. 15/648,908; dated Oct. 27, 2017; 8 pages; USPTO; Alexandria, Virginia.
Gilbert Y. Lee; Notice of Allowance for U.S. Appl. No. 15/649,927; dated Nov. 8, 2017; 7 pages; USPTO; Alexandria, Virginia.
Gilbert Y. Lee; Notice of Allowance for U.S. Appl. No. 15/677,811; dated Nov. 28, 2017; 7 pages; USPTO; Alexandria, Virginia.
Beth A. Stephan; Non-Final Office Action for U.S. Appl. No. 15/681,500; dated Jan. 5, 2018; 10 pages; USPTO; Alexandria, Virginia.
John Nguyen; International Preliminary Report on Patentability for PCT Application No. PCT/US16/19059; dated May 30, 2017; 6 pages; USPTO as IPEA; Alexandria, Virginia.
Shane Thomas; International Search Report and Written Opinion for PCT Application No. PCT/US16/19059; dated May 20, 2016; 7 pages; USPTO as ISA; Alexandria, Virginia.
Harry C. Kim; International Preliminary Report on Patentability for PCT Application No. PCT/US16/66495; dated Jan. 18, 2018; 8 pages; USPTO as IPEA; Alexandria, Virginia.
Shane Thomas; International Search Report and Written Opinion for PCT Application No. PCT/US16/66495; dated Feb. 27, 2017; 7 pages; USPTO as ISA; Alexandria, Virginia.
Shane Thomas; International Search Report and Written Opinion for PCT Application No. PCT/US17/17132; dated May 4, 2017; 6 pages; USPTO as ISA; Alexandria, Virginia.
"Thermaflex Parking Deck Expansion Joint", Emseal (retrieved on Oct. 13, 2017 from https://www.emseal.com/product/thermaflex-parking-deck-expansion-joint/).
"Jeene—Bridge Series", BASF (retrieved on Oct. 13, 2017 from https://wbacorp.com/products/bridge-highway/joint-seals/jeene-bridge).
UL LLC, System No. WW-D-1148, UL Online Certifications Directory, Jul. 22, 2015, retrieved Sep. 5, 2017 from http://database.ul.com/cgi-bin/XYV/template/LISEXT/1FRAME/showpage.html?name=XHBN.WW-D-1148&ccnshorttitle=Joint+Systems&objid=1083778206&cfgid=1073741824&version=versionless&parent_id=1073995560&seguence=1, 1 page, Northbrook, Illinois.
UL LLC, System No. WW-D-1173, UL Online Certifications Directory, May 12, 2015, retrieved Sep. 5, 2017 from http://database.ul.com/cgi-bin/XYV/template/LISEXT/1FRAME/showpage.html?name=XHBN.WW-D-1173&ccnshorttitle=Joint+Systems&objid=1084832391&cfgid=1073741824&version=versionless&parent_id=1073995560&seguence=1, 1 page, Northbrook, Illinois.
UL LLC, System No. WW-D-1148 for Canada, UL Online Certifications Directory, Jul. 22, 2015, retrieved Sep. 5, 2017 from http://database.ul.com/cgi-bin/XYV/template/LISEXT/1FRAME/showpage.html?name=XHBN7.WW-D-1148&ccnshorttitle=Joint+Systems+Certified+for+Canada&objid=1083778211&cfgid=1073741824&version=versionless&parent_id=1073995562&seguence=1, 1 page, Northbrook, Illinois.
UL LLC, System No. WW-D-1173, UL Online Certifications Directory, May 12, 2015, retrieved Sep. 5, 2017 from http://database.ul.com/cgi-bin/XYV/template/LISEXT/1FRAME/showpage.html?name=XHBN7.WW-D-1173&ccnshorttitle=Joint+Systems+Certified+for+Canada&objid=1084832396&cfgid=1073741824&version=versionless&parent_id=1073995562&seguence=1, 1 page, Northbrook, Illinois.
Balco, Inc, CE Series Expansion Joint Seals with Metablock. Sep. 28, 2015, retrieved Sep. 5, 2017 from https://balcousa.com/metablock-ce-fire-barrier-2/, 1 page, Wichita, Kansas, USA.
Advanced Urethane Technologies; Polyurethane Foam Specification Sheet; 1 page; Apr. 1, 2007.
American Institute of Architects, Masterspec, Feb. 1997.
Bonsignore, P.V.; Alumina Trihydrate as a Flame Retardant for Polyurethane Foams; Journal of Cellular Plastics, 174(4): 220-225; Jul./Aug. 1981; 6 pages.
Bonsignore, P.V.; Flame Retardant Flexible Polyurethane Foam by Post-Treatment with Alumina Trihydrate/latex Binder Dispersion Systems;Journal of Cellular Plastics; May-Jun. 1979, pp. 163-179, 17 pages.
Dow Corning USA; Letter of Oct. 4, 1984 to Emseal USA, Inc.; 1 page; Oct. 4, 1984.
Emseal Corporation; Emseal Emseal GreyFlex SpecData; 1984; 4 pages.
Emseal Joint System, Ltd.; 25V; Apr. 1996; 2 pages.
Emseal Joint Systems, Ltd.; Colorseal Tech Data; 2 pages; Feb. 1991.
Emseal Joint System, Ltd.; Colorseal TechData; Jan. 2000.
Emseal Joint Systems, Ltd.; Colorseal in EIFS Application Focus; May 1997; 2 pages.
Emseal Joint Systems, Ltd.; Greyflex Expanding Foam Sealant; Feb. 1992.
Emseal Joint Systems, Ltd.; Greyflex Tech Data; Apr. 1996.
Emseal Joint Systems, Ltd.; The Complete Package for All Joint Requirements; 6 pages; 1988.
Emseal Corporation; Research and Development at Emseal; Jun. 27, 2007; 2 pages.
Envirograf; Product 40: Intumescent-Coated Fireproof Sponge (Patented); Apr. 8, 2007, 2 pages.
Hilti Construction Chemicals, Inc.; CP 604 Flexible Firestop Sealant; 1 page; 2005.
Hilti Construction Chemicals, Inc.; CP 606 Flexible Firestop Sealant; 5 pages; Apr. 25, 2000.
Hilti, Inc.; Firestop Board (CP 675T); 1 page; Apr. 2, 2007 (date shown in Google search: https://www.google.com/search?q=hilti+cp+675&source=Int&tbs=cdr%3A1%2Ccd_min%3A1%2F1%2F1900%2Ccd_max%3A12%2F31%2F2009&tbm).
Hilti Firestop Systems; Untitled; 3 pages; Aug. 2013.

(56) References Cited

OTHER PUBLICATIONS

Hilti, Inc; FS 657 Product Information, Material Safety Data Sheet, and UL Certificate of Compliance; 4 paegs; Feb. 14, 2006.
Hilti Inc.; Material Data Safety Sheet FS 657 Fire Block; CP 658T Firestop Plug; 2 pages; Mar. 1, 2005.
Ilbruck Construction Products; Worldwide solutions to joint-sealing and acoustic problems; Apr. 9, 1998; 77 pages.
Ilbruck; Will-Seal Precompressed expanding foam sealants; Sep. 1988; 4 pages.
Ilbruck Inc.; Willseal precompressed foam sealants; 1991; 4 pages.
Ilbruck/USA; Will-Seal (binder); 39 pages; 1984.
Ilbruck; Product Data Sheet Compriband MPA; Apr. 2000; 2 pages.
Ilbruck Sealant Systems, inc.; Fax-Message of Jan. 30, 2002; Jan. 30, 2002; 14 pages.
Ilbruck Sealant Systems, inc.; Fax-Message of Feb. 15, 2002; Feb. 15, 2002; 14 pages.
Iso-Chemie GmbH; Sicherheitsdatenblatt (ISO Flame Kombi F120); Jun. 30, 2004; 3 pages.
IsoChemie; Invoice 135652 to Schul International Co., LLC. for Iso-Bloco 600 and Iso-Flame Kombi F120; Apr. 26, 2007; 3 pages // IsoChemie; Order Confirmation 135652 to Schul International Co., LLC. for Iso-Bloco 600 and Iso-Flame Kombi F120; Apr. 26, 2007; 3 pages // IsoChemie; Correspondence of Jun. 8, 2006 and prior; 13 pages // Schul International Company; Invoice 18925 to P.J., Spillane; Sep. 14, 2007; 6 pages.
Katz, Harry S. and Milewski, John V.; Handbook of Fillers for Plastics; 1987; pp. 292-312.
Polytite Manufacturing Corp.; Spec Section 07920 Polytite Expansion Joint System; 1 page; May 1989.
Sandell Manufacturing Company, Inc.; About Polyseal—procompressed joint sealant—from Sandell Manufacturing; 2 pages; Mar. 15, 1999.
Sandell Manufacturing Company, Inc.; Polyseal Precompressed Joint Sealant; 2 pages; Available by Jan. 31, 2000.
Sandell Manufacturing Company, Inc.; Polytite Sealant & Construction Gasket; 1 page; 1978.
Schul International Co., LLC.; Seismic Sealtite "R"; 2 pages; 2002.
Soudal NV; Soudaband Acryl; Jun. 7, 2005; 4 pages.
Tremco Illbruck; Illbruck illmod Trio; Jun. 2007; 2 pages.
Tremco illbruck Produktion GmbH; Materials Safety Data Sheet (illmod 600); Mar. 2, 2007; 4 pages.
Westinghouse Savanah River Company; Design Proposal for Sealing Gap at Z-Area Saltstone Vault One, Cell A (U); 6 pages; Jul. ages; Jul. 26, 1994; Aiken, South Carolina, available at http://pbadupws.nrc.gov/docs/ML0901/ML090120164.pdf, indexed by Google.
Stephan, Beth A; Non-Final Office Action for U.S. Appl. No. 15/681,500; dated Mar. 20, 2018; 7 pages; USPTO; Alexandria, Virginia.
Agudelo, Paola; Non-Final Office Action for U.S. Appl. No. 15/885,028; dated Mar. 30, 2018; 7 pages; USPTO; Alexandria, Virginia.
Adolf Wurth GmbH & Co. KG; 81 Elastic Joint Sealing Tape; retrieved Aug. 5, 2005; 4 pages.
Amber Composites; Expanding PU Foam Technical Data Sheet (Premier BG1); Feb. 1997; 2 pages.
ASTM International; ASTM E84-04; 2004; 19 pages.
ASTM International; Designation E 176-07 Standard Terminology of Fire Standards; 2007; 20 pages.
ASTM International; Standard Terminology of Fire Standards; Nov. 11, 2014; 20 pages.
Auburn Manufacturing Company; Auburn Product News—R-10400M; Dec. 2007; 1 page.
AWCI Construction Dimensions; Where's the Beef in Joint Sealants? Hybrids Hold the Key by Lester Hensley; Jan. 2006 3 pages.
British Board of Agrement; Compriband 600 Sealing Tapes—Certificate 96/3309; Jul. 14, 2005; 8 page.
Bristish Board of Agrement; Compriband Super—Certificate 97/3331; Aug. 2, 2005; 4 pages.
British Board of Agrement; Illmod 600 Sealing Tapes; Mar. 26, 2003; 8 pages.
British Standards Institute; Translation—NEN 6069; Oct. 1991; 31 pages.
British Standards Institution; Fire tests on building materials and structures (BS476:Part 20); 1987; 44 pages.
Building and Engineering Standards Committee; Impregnated cellular plastics strips for sealing external joints—DIN 18542; Jan. 1999; 10 pages.
BuildingTalk; Choosing a sealant for building applications by Lester Hensley CEO and President of Emseal; May 21, 2007, 6 pages.
Centre for Fire Research; Determination of the Fire Resistance According to NEN 6069 of Joints in a Wall Sealed with Cocoband 6069 Impregnated Foam Strip; Nov. 1996; 19 pages.
DIN ev; Fire behavior of building materials and building components; Sep. 1977; 11 pages.
DIN ev; Fire behavior of building materials and building components; May 1998; 33 pages.
DIN ev; Fire behavior of building materials and elements; Mar. 1994; 144 pages.
Dow Corning; Dow Corning 790 Silicone Building Sealant; 1999; 8 pages.
Dow Corning; Dow Corning 790 Silicone Building Sealant; 2000; 6 pages.
Dow Corning; Dow Corning 790 Silicone Building Sealant; 2004; 4 pages.
Dow Corning; Dow Corning Firestop 400 Silicone Sealant; Jan. 15, 2001; 4 pages.
Dow Corning; Dow Corning Firestop 700 Silicone Sealant; Jan. 15, 2001; 6 pages.
Emseal Joint Systems Ltd.; Horizontal Colorseal Aug. 2000 2 pages.
Emseal Joint Systems Ltd.; Colorseal PC/SA Stick; 1 page; Jun. 7 1995.
Emseal Joint Systems Ltd.; SJS-100-CHT-RN; 1 page; Nov. 20, 2007.
Emseal Joint Systems Ltd; 20H System Tech Data; Jun. 1997; 2 pages.
Emseal Joint Systems Ltd; Colorseal Aug. 2000 2 pages.
Emseal Joint Systems Ltd; DSH System; Nov. 2005; 2 pages.
Emseal Joint Systems Ltd; Fire-Rating of Emseal 20H System; Author of "LH"; Feb. 17, 1993/Apr. 18, 1993; 2 pages.
Emseal Joint Systems Ltd; Horizontal Colorseal Tech Data; Jun. 1997; 2 pages.
Emseal Joint Systems Ltd; Preformed Sealants and Expansion Joint Systems; May 2002, 4 pages.
Emseal Joint Systems Ltd; Seismic Colorseal; Apr. 1998; 2 pages.
Emseal Joint Systems Ltd; Preformed Sealants and Expansion Joints.; Jan. 2002; 4 pages.
Emseal Joint Systems; Seismic Colorseal; Aug. 2000; 2 pages.
Emseal; Benchmarks of Performance for High Movement Acrylic-Impregnated Precompressed Foam Sealants; Aug. 21, 2007; 7 pages.
Emseal; Seismic Colorseal—DS (Double Sided); Apr. 12, 2007; 4 pages.
Envirograf; Fire Kills; 2004; 8 pages available by at least Nov. 10, 2006 per Archive.org.
Fire Retardants Inc.; Fire Barrier CP 25WB + Caulk; 2002; 4 pages.
IBMB; Test 3002/2719—Blocostop F120; Mar. 24, 2000; 14 pages.
IBMB; Test 3263/5362—Firestop N; Jul. 18, 2002; 13 pages.
IBMB; Test 3568/2560; Sep. 30, 2005; 14 pages.
IFT Rosenheim; Evidence of Performance—Test Report 105 32469/1e U R1; Apr. 19, 2006; 8 pages.
Illbruck Bau-Produkte GmbH u Co. KG; Willseal Firestop; Sep. 30, 1995; 2 pages.
Illbruck Inc.; Will-Seal 250 Spec Data; Aug. 1989; 2 pages.
Illbruck International; willseal the joint sealing tape; Jan. 1991; 19 pages.
Illbruck Sealant Systems inc..; Illbruck Willseal 600; Sep. 2001; 2 pages.
Illbruck USA; MSDS—Willseal 150/250 and/or EPS; Jul. 21, 1986; 2 pages.
Illbruck/USA; Will-Seal 150 Spec Data; Nov. 1987; 2 pages.
Iso Chemie GmbH; Iso-Bloco 600; 2 pages; Jul. 1, 2006.

(56) References Cited

OTHER PUBLICATIONS

UL, LLC; Online Certifications Directory; "System No. WW-D-1092, XHBN.WW-D-1092 Joint Systems"; Sep. 24, 2012; retrieved on Feb. 1, 2018 from http://database.ul.com/cgi-bin/XYV/template/LISEXT/1FRAME/showpage.html?name=XHBN.WW-D-1092&ccnshorttitle=Joint+Systems&objid=1082471646&cfgid=1073741824&version=versionless&parent_id=1073995560&sequence=1; 2 pages.
UL, LLC; Online Certifications Directory; "System No. WW-D-1093, XHBN.WW-D-1093 Joint Systems";Oct. 6, 2014; retrieved on Feb. 1, 2018 from http://database.ul.com/cgi-bin/XYV/template/LISEXT/1FRAME/showpage.html?name=XHBN.WW-D-1093&ccnshorttitle=Joint+Systems&objid=1082823956&cfgid=1073741824&version=versionless&parent_id=1073995560&sequence=1; 3 pages.
UL, LLC; Online Certifications Directory; "System No. HW-D-1098, XHBN.HW-D-1098 Joint Systems"; Jun. 6, 2013; retrieved on Feb. 1, 2018 from http://database.ul.com/cgi-bin/XYV/template/LISEXT/1FRAME/showpage.html?name=XHBN.HW-D-1098&ccnshorttitle=Joint+Systems&objid=1082700131&cfgid=1073741824&version=versionless&parent_id=1073995560&sequence=1; 3 pages.
UL, LLC; Online Certifications Directory; "System No. FF-D-1100, XHBN.FF-D-1100 Joint Systems"; Sep. 24, 2012; retrieved on Feb. 1, 2018 from http://database.ul.com/cgi-bin/XYV/template/LISEXT/1FRAME/showpage.html?name=XHBN.FF-D-1100&ccnshorttitle=Joint+Systems&objid=1082567162&cfgid=1073741824&version=versionless&parent_id=1073995560&sequence=1; 2 pages.
UL, LLC; Online Certifications Directory; "System No. WW-D-1101, XHBN.WW-D-1101 Joint Systems"; Oct. 6, 2014; retrieved on Feb. 1, 2018 from http://database.ul.com/cgi-bin/XYV/template/LISEXT/1FRAME/showpage.html?name=XHBN.WW-D-1101&ccnshorttitle=Joint+Systems&objid=1082823966&cfgid=1073741824&version=versionless&parent_id=1073995560&sequence=1; 2 pages.
UL, LLC; Online Certifications Directory; "System No. WW-D-1102, XHBN.WW-D-1102 Joint Systems"; Sep. 24, 2012; retrieved on Feb. 1, 2018 from http://database.ul.com/cgi-bin/XYV/template/LISEXT/1FRAME/showpage.html?name=XHBN.WW-D-1102&ccnshorttitle=Joint+Systems&objid=1082699876&cfgid=1073741824&version=versionless&parent_id=1073995560&sequence=1; 2 pages.
UL, LLC; Online Certifications Directory; "System No. FF-D-1109, XHBN.FF-D-1109 Joint Systems"; Jul. 29, 2013; retrieved on Feb. 1, 2018 from http://database.ul.com/cgi-bin/XYV/template/LISEXT/1FRAME/showpage.html?name=XHBN.FF-D-1109&ccnshorttitle=Joint+Systems&objid=1082845106&cfgid=1073741824&version=versionless&parent_id=1073995560&sequence=1; 2 pages.
UL, LLC; Online Certifications Directory; "System No. FF-D-1110, XHBN.FF-D-1110 Joint Systems"; Nov. 1, 2013; retrieved on Feb. 1, 2018 from http://database.ul.com/cgi-bin/XYV/template/LISEXT/1FRAME/showpage.html?name=XHBN.FF-D-1110&ccnshorttitle=Joint+Systems&objid=1082845102&cfgid=1073741824&version=versionless&parent_id=1073995560&sequence=1; 2 pages.
UL, LLC; Online Certifications Directory; "System No. WW-D-1119, XHBN.WW-D-1119 Joint Systems"; Jul. 29, 2013; retrieved on Feb. 1, 2018 from http://database.ul.com/cgi-bin/XYV/template/LISEXT/1FRAME/showpage.html?name=XHBN.WW-D-1119&ccnshorttitle=Joint+Systems&objid=1083149741&cfgid=1073741824&version=versionless&parent_id=1073995560&sequence=1; 3 pages.
UL, LLC; Online Certifications Directory; "System No. WW-D-1120, XHBN.FF-D-1120 Joint Systems"; Jun. 6, 2013; retrieved on Feb. 1, 2018 from http://database.ul.com/cgi-bin/XYV/template/LISEXT/1FRAME/showpage.html?name=XHBN.WW-D-1120&ccnshorttitle=Joint+Systems&objid=1083149707&cfgid=1073741824&version=versionless&parent_id=1073995560&sequence=1; 2 pages.
UL, LLC; Online Certifications Directory; "System No. FF-D-1148, XHBN.FF-D-1148 Joint Systems"; May 15, 2014; retrieved on Feb. 1, 2018 from http://database.ul.com/cgi-bin/XYV/template/LISEXT/1FRAME/showpage.html?name=XHBN.FF-D-1148&ccnshorttitle=Joint+Systems&objid=1084034211&cfgid=1073741824&version=versionless&parent_id=1073995560&sequence=1; 2 pages.
UL, LLC; Online Certifications Directory; "System No. WW-D-1152, XHBN.WW-D-1152 Joint Systems"; Aug. 14, 2014; retrieved on Feb. 1, 2018 from http://database.ul.com/cgi-bin/XYV/template/LISEXT/1FRAME/showpage.html?name=XHBN.WW-D-1152&ccnshorttitle=Joint+Systems&objid=1084034221&cfgid=1073741824&version=versionless&parent_id=1073995560&sequence=1; 2 pages.
UL, LLC; Online Certifications Directory; "System No. WW-D-1153, XHBN.WW-D-1153 Joint Systems"; Aug. 20, 2014; retrieved on Feb. 1, 2018 from http://database.ul.com/cgi-bin/XYV/template/LISEXT/1FRAME/showpage.html?name=XHBN.WW-D-1153&ccnshorttitle=Joint+Systems&objid=1084052791&cfgid=1073741824&version=versionless&parent_id=1073995560&sequence=1; 2 pages.
UL, LLC; Online Certifications Directory; "System No. WW-D-1154, XHBN.WW-D-1154 Joint Systems"; Jun. 16, 2014; retrieved on Feb. 1, 2018 from http://database.ul.com/cgi-bin/XYV/template/LISEXT/1FRAME/showpage.html?name=XHBN.WW-D-1154&ccnshorttitle=Joint+Systems&objid=1084052801&cfgid=1073741824&version=versionless&parent_id=1073995560&sequence=1; 2 pages.
UL, LLC; Online Certifications Directory; "System No. FF-D-1156, XHBN.FF-D-1156 Joint Systems"; Nov. 9, 2015; retrieved on Feb. 1, 2018 from http://database.ul.com/cgi-bin/XYV/template/LISEXT/1FRAME/showpage.html?name=XHBN.FF-D-1156&ccnshorttitle=Joint+Systems&objid=1085235671&cfgid=1073741824&version=versionless&parent_id=1073995560&sequence=1; 2 pages.
UL, LLC; Online Certifications Directory; "System No. FF-D-1157, XHBN.FF-D-1157 Joint Systems"; Nov. 9, 2015; retrieved on Feb. 1, 2018 from http://database.ul.com/cgi-bin/XYV/template/LISEXT/1FRAME/showpage.html?name=XHBN.FF-D-1157&ccnshorttitle=Joint+Systems&objid=1085235726&cfgid=1073741824&version=versionless&parent_id=1073995560&sequence=1; 2 pages.
Schul International; Firejoint 2FR-H & Firejoint 3FR-H; 2012; 2 pages.
Schul International; Firejoint 2FR-V & Firejoint 3FR-V; 2012; 2 pages.
UL, LLC; Online Certifications Directory; "System No. HW-D-1101, XHBN.HW-D-1101 Joint Systems"; Sep. 11, 2013; retrieved on Feb. 1, 2018 from http://database.ul.com/cgi-bin/XYV/template/LISEXT/1FRAME/showpage.html?name=XHBN.HW-D-1101&ccnshorttitle=Joint+Systems&objid=1083156306&cfgid=1073741824&version=versionless&parent_id=1073995560&sequence=1; 3 pages.
UL, LLC; Online Certifications Directory; "System No. FF-D-1121, XHBN.FF-D-1121 Joint Systems"; Apr. 25, 2013; retrieved on Feb. 1, 2018 from http://database.ul.com/cgi-bin/XYV/template/LISEXT/1FRAME/showpage.html?name=XHBN.FF-D-1121&ccnshorttitle=Joint+Systems&objid=1083156406cfgid=1073741824&version=versionless&parent_id=1073995560&sequence=1; 2 pages.
UL, LLC; Online Certifications Directory; "System No. FF-D-1122, XHBN.FF-D-1122 Joint Systems"; Sep. 11, 2013; retrieved on Feb. 1, 2018 from http://database.ul.com/cgi-bin/XYV/template/LISEXT/1FRAME/showpage.html?name=XHBN.FF-D-1122&ccnshorttitle=Joint+Systems&objid=1083156361&cfgid=1073741824&version=versionless&parent_id=1073995560&sequence=1; 2 pages.
UL, LLC; Online Certifications Directory; "System No. FF-D-1123, XHBN.FF-D-1123 Joint Systems"; Sep. 11, 2013; retrieved on Feb. 1, 2018 from http://database.ul.com/cgi-bin/XYV/template/LISEXT/1FRAME/showpage.html?name=XHBN.FF-D-1123&ccnshorttitle=Joint+Systems&objid=1083156331&cfgid=1073741824&version=versionless&parent_id=1073995560&sequence=1; 2 pages.
UL, LLC; Online Certifications Directory; "System No. WW-D-1124, XHBN.WW-D-1124 Joint Systems"; Sep. 11, 2013; retrieved on Feb. 1, 2018 from http://database.ul.com/cgi-bin/XYV/template/LISEXT/1FRAME/showpage.html?name=XHBN.WW-D-1124&ccnshorttitle=Joint+Systems&objid=1083156186&cfgid=1073741824&version=versionless&parent_id=1073995560&sequence=1; 2 pages.
UL, LLC; Online Certifications Directory; "System No. WW-D-1125, XHBN.WW-D-1125 Joint Systems"; Apr. 25, 2013; retrieved on Feb. 1, 2018 from http://database.ul.com/cgi-bin/XYV/template/LISEXT/1FRAME/showpage.html?name=XHBN.WW-D-1125&ccnshorttitle=Joint+Systems&objid=1083156176&cfgid=1073741824&version=versionless&parent_id=1073995560&sequence=1; 2 pages.
UL, LLC; Online Certifications Directory; "System No. WW-D-1126, XHBN.WW-D-1126 Joint Systems"; Sep. 11, 2013; retrieved on Feb. 1, 2018 from http://database.ul.com/cgi-bin/XYV/template/LISEXT/1FRAME/showpage.html?name=XHBN.WW-D-1125&ccnshorttitle=Joint+Systems&objid=1083156461&cfgid=1073741824&version=versionless&parent_id=1073995560&sequence=1; 2 pages.

(56) References Cited

OTHER PUBLICATIONS

UL, LLC; Online Certifications Directory; "System No. WW-D-1127, XHBN.WW-D-1127 Joint Systems"; Sep. 11, 2013; retrieved on Feb. 1, 2018 from http://database.ul.com/cgi-bin/XYV/template/LISEXT/1FRAME/showpage.html?name=XHBN.WW-D-1127&ccnshorttitle=Joint+Systems&objid=1083156441&cfgid=1073741824&version=versionless&parent_id=1073995560&sequence=1; 3 pages.
UL, LLC; Online Certifications Directory; "System No. FF-D-1151, XHBN.FF-D-1151 Joint Systems"; Aug. 20, 2014; retrieved on Feb. 1, 2018 from http://database.ul.com/cgi-bin/XYV/template/LISEXT/1FRAME/showpage.html?name=XHBN.FF-D-1151&ccnshorttitle=Joint+Systems&objid=1084241891&cfgid=1073741824&version=versionless&parent_id=1073995560&sequence=1; 2 pages.
UL, LLC; Online Certifications Directory; "System No. WW-D-1160, XHBN.WW-D-1160 Joint Systems"; Aug. 20, 2014; retrieved on Feb. 1, 2018 from http://database.ul.com/cgi-bin/XYV/template/LISEXT/1FRAME/showpage.html?name=XHBN.WW-D-1160&ccnshorttitle=Joint+Systems&objid=1084241902&cfgid=1073741824&version=versionless&parent_id=1073995560&sequence=1; 2 pages.
UL, LLC; Online Certifications Directory; "System No. WW-D-1161, XHBN.WW-D-1161 Joint Systems"; Aug. 20, 2014; retrieved on Feb. 1, 2018 from http://database.ul.com/cgi-bin/XYV/template/LISEXT/1FRAME/showpage.html?name=XHBN.WW-D-1161&ccnshorttitle=Joint+Systems&objid=1084241911&cfgid=1073741824&version=versionless&parent_id=1073995560&sequence=1; 3 pages.
UL, LLC; Online Certifications Directory; "System No. WW-D-1162, XHBN.WW-D-1162 Joint Systems"; Aug. 20, 2014; retrieved on Feb. 1, 2018 from http://database.ul.com/cgi-bin/XYV/template/LISEXT/1FRAME/showpage.html?name=XHBN.WW-D-1162&ccnshorttitle=Joint+Systems&objid=1084241921&cfgid=1073741824&version=versionless&parent_id=1073995560&sequence=1; 2 pages.
UL, LLC; Online Certifications Directory; "System No. FF-D-1174, XHBN.FF-D-1174 Joint Systems"; Jul. 11, 2016; retrieved on Feb. 1, 2018 from http://database.ul.com/cgi-bin/XYV/template/LISEXT/1FRAME/showpage.html?name=XHBN.FF-D-1174&ccnshorttitle=Joint+Systems&objid=1085930212&cfgid=1073741824&version=versionless&parent_id=1073995560&sequence=1; 2 pages.
UL, LLC; Online Certifications Directory; "System No. FF-D-1175, XHBN.FF-D-1174 Joint Systems"; Jul. 12, 2016; retrieved on Feb. 1, 2018 from http://database.ul.com/cgi-bin/XYV/template/LISEXT/1FRAME/showpage.html?name=XHBN.FF-D-1175&ccnshorttitle=Joint+Systems&objid=1085930226&cfgid=1073741824&version=versionless&parent_id=1073995560&sequence=1; 2 pages.
Willseal, LLC; Willseal FR-2V; Mar. 4, 2013; 6 pages.
Willseal, LLC; Willseal FR-2H; Mar. 4, 2013; 6 pages.
Willseal, LLC; Willseal FR-V; dated 2013; 6 pages.
Nillseal, LLC; Willseal FR-H; dated 2013; 6 pages.
Schul International Company, LLC; Firejoint 2FR-H & Firejoint 2FR-V; Aug. 2014; 3 pages.
Willseal, LLC; Willseal FR-2H & Willseal FR-2V; Mar. 4, 2013; 3 pages.
Willseal LLC; Willseal FR-H / Willseal FR-V; Oct. 2016; retrieved on Feb. 2, 2018 from https://willseal.com/wp-content/uploads/2016/10/WillsealFR_Install.pdf; 3 pages.
Schul International Company, LLC; Sealtite 50N; May 9, 2007; 2 pages.
Schul International Company, LLC; Seismic Sealtite; May 9, 2007; 2 pages.
Willseal LLC; MSDS for Willseal FR-V & FR-H; Jul. 19, 2013; 11 pages.
Schul International Company, LLC; Firejoint 2FR-V +50; dated 2012; 2 pages.

* cited by examiner

EXPANSION JOINT SEAL FOR SURFACE CONTACT WITH OFFSET RAIL

CROSS-REFERENCE TO RELATED APPLICATIONS

None.

STATEMENT REGARDING FEDERALLY SPONSORED RESEARCH OR DEVELOPMENT

Not Applicable.

BACKGROUND

Field

The present disclosure relates generally to systems for creating a durable seal between adjacent panels, including those which may be subject to temperature expansion and contraction or mechanical shear. More particularly, the present disclosure is directed to a seismic-capable expansion joint design for use in surfaces and transitions exposed to impact or transfer loads such as foot or vehicular traffic areas.

Description of the Related Art

Construction panels come in many different sizes and shapes and may be used for various purposes, including roadways, sideways, and pre-cast structures, particularly buildings. Historically, these have been formed in place. Use of precast concrete panels for floors, however, has become more prevalent. Whether formed in place or by use of precast panels, designs generally require forming a lateral gap or joint between adjacent panels to allow for independent movement, such in response to ambient temperature variations within standard operating ranges, building settling or shrinkage and seismic activity. Moreover, these joints are subject to damage over time. Most damage is from vandalism, wear, environmental factors and when the joint movement is greater, the seal may become inflexible, fragile or experience cohesive and/or adhesive failure. As a result, "long lasting" in the industry refers to a joint likely to be usable for a period greater than the typical lifespan of five (5) years. Various seals have been created in the field. Moreover, where in a horizontal surface exposed to wear, such as a roadway or walkway, it is often desirable to ensure that contaminants are retarded from contacting the seal and that the joint does not present a tripping hazard, whether as a result of a joint seal system which extends above the adjacent substrates or as a result of positioning the joint seal system below the surface of the substrates. This may be particularly difficult to address as the size of the expansion joint increases.

Various seal systems and configurations have been developed for imposition between these panels to provide seals or expansion joints to provide one or more of fire protection, waterproofing, sound and air insulation. This typically is accomplished with a seal created by imposition of multiple constituents in the joint, such as silicone application, backer bars, and elastically-compressible cores, such as of foam. While such foams may take a compression set, limiting the capability to return to the maximum original uncompressed dimension, such foams do permit compression and some return toward to the maximum original uncompressed dimension.

Other systems have incorporated cover plates that span the joint itself, often anchored to the concrete or attached to the expansion joint material and which are expensive to supply and install. These systems sometimes require potentially undesirable mechanical attachment, which requires drilling into the deck or joint substrate. Cover plate systems that are not mechanically attached rely on support or attachment to the expansion joint, thereby subjecting the expansion joint seal system to continuous compression, expansion and tension on the bond line when force is applied to the cover plate, which shortens the life of the joint seal system. Some of these systems use an elastically-compressible core of foam to provide sealing, i.e. a foam which may be compressed by has sufficient elasticity to expand as the external force is removed until reaching a maximum expansion. But these elastically-compressible core systems can take on a compression set when the joint seal system is repeatedly exposed to lateral forces from a single direction, such as a roadway. This becomes more pronounced as these elastically-compressible core systems utilize a single or continuous spine along the length of the expansion joint seal system—which propagates any deflection along the length. The problems and limitations of the current elastically-compressible core sealing cover plate systems that rely on a continuous spline are well known in the art.

SUMMARY

The present disclosure therefore meets the above needs and overcomes one or more deficiencies in the prior art.

The disclosure provides an expansion joint seal system preferably comprising a cover plate, a vertically-oriented elongate rail adapted for attachment to a substrate, and an elastically-compressible core adapted to contact the vertically-oriented elongate rail.

Additional aspects, advantages, and embodiments of the disclosure will become apparent to those skilled in the art from the following description of the various embodiments and related drawings. Where the cover plates are separated by a compression bumper/seal.

BRIEF DESCRIPTION OF THE DRAWINGS

So that the manner in which the described features, advantages, and objects of the disclosure, as well as others which will become apparent, are attained and can be understood in detail; more particular description of the disclosure briefly summarized above may be had by referring to the embodiments thereof that are illustrated in the drawings, which drawings form a part of this specification. It is to be noted, however, that the appended drawings illustrate only typical preferred embodiments of the disclosure and are therefore not to be considered limiting of its scope as the disclosure may admit to other equally effective embodiments.

In the drawings.

DETAILED DESCRIPTION

An expansion joint seal system 100 is provided for an expansion joint. The expansion joint is formed of a first substrate 106 and a second substrate 1104. The expansion joint is formed as the first substrate 106 is separated, or distant, the second substrate 1114. By selection of the properties of its various elements, the expansion joint seal system 100 may provide sufficient fire endurance and movement to obtain at least the minimum certification under fire rating standards. The selection of fire retardant components permits protection sufficient to pass a building code fire endurance protection, such as for one hour under ASTM E 1399.

Figure 1:
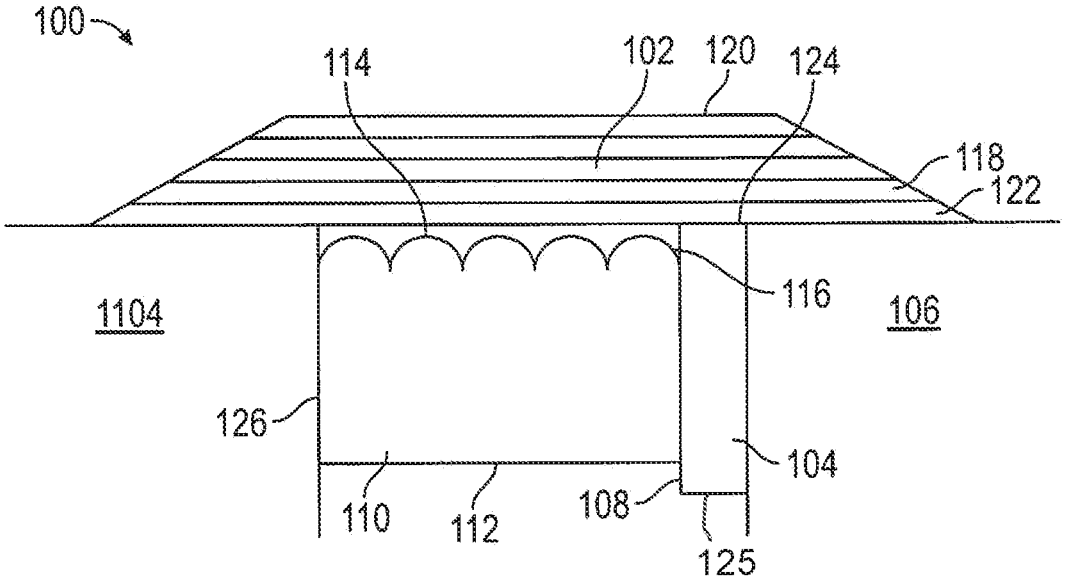
FIG. 1 provides an end view of one embodiment of the present disclosure.

Referring to FIG. 1, the expansion joint seal system 100 may have a cover plate 102, a rail 104, and an elastically-compressible core 110. Unlike conventional expansion joint seals with cover plates, the present disclosure provides a spine or spline not depending downward from the centerline of the cover plate. The rail 104 may be permanently attached to the cover plate 102 or may be detachably attached. A detachable attachment may be preferable where the cover plate 102 may be struck by equipment, so that such a strike merely disengages the cover plate 102 from the expansion joint seal system 100, permitting the balance of the seal to continue providing some protection, rather than being likewise removed. Any system of attachment may be used, such as screws or bolts, as well as a keyed member to lock, and unlock, the cover plate 102 and the rail 102. A keyed member, for example, may reduce the potential for modification or vandalism as the tools for removal of the cover plate 102 are not readily available.

Each of the components may be sized to address loading, whether thin or substantially thick.

The elastically-compressible core 110 may have a core bottom surface 112, a core top surface 114 and a core first side 116 and may be adapted at the core first side 116 to contact the rail 104 at the rail first side 108. The elastically-compressible core 110 may be a foam, such as an open cell foam, a lamination of open cell foam and close cell foam, and closed cell foam. When desired, the elastically compressible core 110 may have a treatment, such as impregnation, to increase desirable properties, such as fire resistance or water resistance, by, respectively, the introduction of a fire retardant into the foam or the introduction of a water inhibitor into the foam. Further, the elastically-compressible core 110 may be composed of a hydrophilic material, a hydrophobic material, a fire-retardant material, or a sintering material. Upon installation in an expansion joint, the elastically-compressible core 110 remains in compression. Prior to installation, the elastically-compressible core 110 may be relaxed or pre-compressed.

The elastically-compressible core 110 prior to compression is wider than the nominal size of the expansion joint. When the elastically-compressible core 110 is imposed between the first substrate 106 and the second substrate 1104, the elastically-compressible core 110 is maintained in compression between the second substrate 1104 and the rail 104 and, by virtue of its nature, inhibits the transmission of water or other contaminants further into the expansion joint. An adhesive may be applied to the substrate end faces or to the elastically-compressible core first side 116 and/or the elastically-compressible core second side 126 to ensure a bond between the expansion joint seal system 100 and the-second substrate 1104 and the rail 104. Over time, as the distance between the second substrate 1104 and the rail 104 changes, such as during heating and during cooling, the elastically-compressible core 110 expands to fill the void of the expansion joint or is compressed to fill the void of the expansion joint. Preferably, the elastically-compressible core 110 is a single body of foam, but may be a lamination of several layers, or the combination of several elements adhered together to provide desired mechanical and/or functional characteristics and may comprise multiple glands and/or rigid layers that collapse under seismic loads. The elastically-compressible core 110 may be of polyurethane foam and may be open celled foam or closed cell. A combination of open and closed cell foams may alternatively be used. The elastically-compressible core 110 may contain hydrophilic, hydrophobic or fire-retardant compositions as impregnates, or as surface infusions, as vacuum infusion, as injections, full or partial, or combinations of them. Moreover, near the core top surface 130 the elastically-compressible core 110 may be caused to contain, such as by impregnation or infusion, a sintering material, wherein the particles in the impregnate move past one another with minimal effort at ambient temperature but form a solid upon heating. Once such sintering material is clay or a nano-clay. Such a sintering impregnate would provide an increased overall insulation value and permit a lower density at installation than conventional foams while still having a fire endurance capacity of at least one hour, such as in connection with the UL 2079 standard for horizontal and vertical joints. While the cell structure, particularly, but not solely, when compressed, of an elastically-compressible core 110 preferably inhibits the flow of water, the presence of an inhabitant or a fire retardant may prove additionally beneficial. The fire retardant may be introduced as part of the foaming process, or by impregnating, coating, infusing, or laminating, or by other processes known in the art.

The rail 104 is composed of a resilient material which resists the effects of moisture and heat/cold. Preferably, the rail 104 is composed of a thin vertically-oriented rectangular prism of metal or plastic, but other materials, such as a high-density foam, may be used. The rail 104 may be composed of, may contain, or may be coated with materials to resist water penetration and fire penetration, such as a hydrophilic material, a hydrophobic material, a fire-retardant material, an electrically conductive material, a carbon fiber material, and an intumescent material.

The rail 104 may be vertically-oriented, elongate, and adapted for attachment to a substrate 106 at a rail second side 128. The attachment may be mechanical or by adhesive. A load-absorbing layer, such as a foam, may be applied to the rail 104 at the rail second side 128. The rail 104 may have a rail first side 108 opposite the rail second side 128. The rail 104 may have an adhesive on the rail first side 108 and/or on the rail second side 126. A plurality of rails 104 may be used, particularly where localized expansion and contraction are expected, such as around a curved surface, in down ramps, turning lanes or where forklift traffic is anticipated. Alternatively, the rail 104 may provide a long, continuous surface to dissipate local forces throughout the entire elastically-compressible core 110. The rail 104 may include at a rail top surface 124, a connecting member, which may be, for example, a hinge 302, a tether 402, or a flexible member 502. Such a connecting member 302, 402, 502 may be provide temporary or non-permanent attachment of the rail 104 to the cover plate 102. Expansion joint seal systems are often installed under conditions where mechanical strikes against the cover plate 102 are likely, such as roadways in locales which use snow plows. When used, snow plows employ a blade positioned at the roadway surface to scrape snow and ice from the roadway for removal. Any objects which extend above the roadway surface sufficient to contact the plow are likely to ripped from the roadway surface. It may therefore be preferable for the cover plate 102 to be detachably attached magnetically to the rail 104 and retained with a tether 402 to prevent the cover plate 102 from falling into the joint between the first substrate 106 and the second substrate 1104. The tether 402, which may be also attached to the elastically-compressible core 110, may further prevent the elastically-compressible core 110 from sagging away from the cover plate 102, a problem known in the prior art. The tether 402 may be highly flexible, resilient material sufficient to sustain the impact load and sufficiently durable to do so the life of the expansion joint seal system 100. Alternatively, the cover plate 102 may be detachably attached to the rail 104 using screws, bolts or other devices prepared to break-away in the event of a strike.

The cover plate 102 is typically rectangular and preferably made of a material sufficiently resilient to sustain and be generally undamaged by the surface traffic atop it for a period of at least five (5) years and of a material and thickness sufficient to transfer any loads to the substrates which it contacts. The cover plate 102 may be constructed of a single layer or of multiple cover plate layers 118. Construction of the cover plate 102 of multiple layers 118 enables repair or replacements of wear surfaces without replacing the entire cover plate 102 or replacing the elastically-compressible core 110. Each layer 118 is selected from a durable material which may be bonded, adhered or mechanically attached/affixed to an adjacent layer 118, but which may be separated by the adjacent layer 118 upon the desired minimum lateral or shear force. One or more of those multiple cover plate layers 118 may be a replaceable wear surface 120. The multiple cover plate layers 118 may include a bottom layer 122 and a water-permeable wear surface 120 atop the bottom layer 122. The cover plate 102 has a cover plate width 130. To perform its function when positioned atop the expansion joint, and to provide a working surface, the cover plate width 122 typically is greater than the first distance 132 between the first substrate 106 and the second substrate 1104. Alternatively, rather than being positioned atop the expansion joint, the cover plate 102 may be installed flush or below the top of substrate 106 and/or installed flush or below the surface of substrate 106. The contact point for cover plate 102 may be the deck or wall substrate or may be a polymer or elastomeric material to reduce wear and to facilitate the movement function of the cover plate 102. Regardless of the intended position, the cover plate 102 may be constructed without restriction as to its profile. When desired, the cover plate 120 may be eliminated, together with attached components. The cover plate 102 may also be sized for imposition into a concrete or polymer nosing, allowing for a generally-flat surface for snow plowing. The cover plate 102 may have a length greater than the rail 104.

Figure 2:
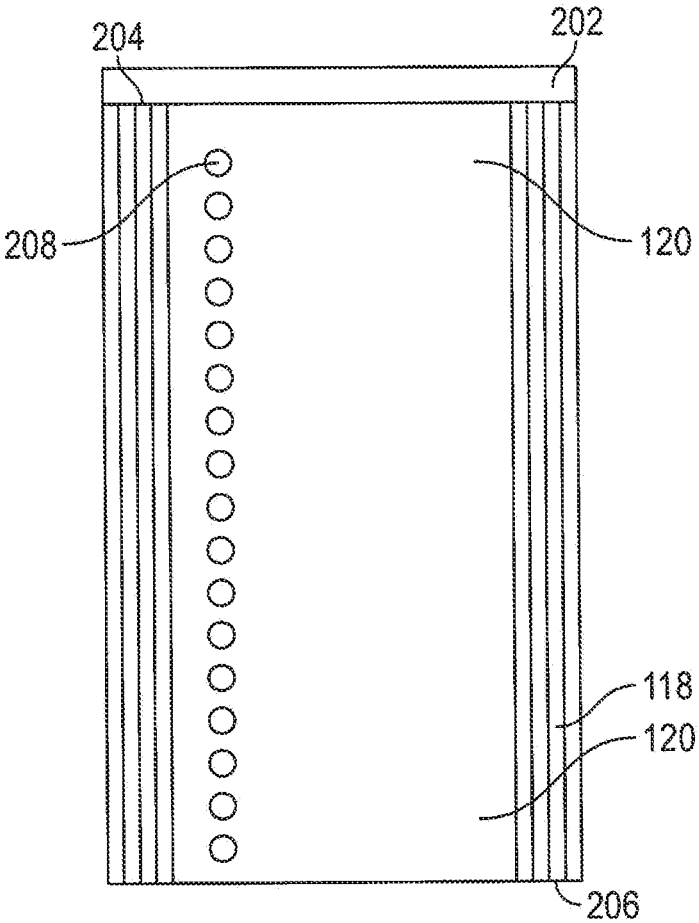
FIG. 2 provides a top view of a cover plate of one embodiment of the present disclosure.

Referring to FIG. 2, a top view of a cover plate 102 of one embodiment of the present disclosure, the cover plate 102 may be provided to present a solid, generally impermeable surface, or may be provided to present a permeable surface. The cover plate 102 may have a plurality of openings 208 therethrough. These openings 208 may reduce the surface area of the cover plate 102 by as much as ninety percent (90%).

Figure 3:
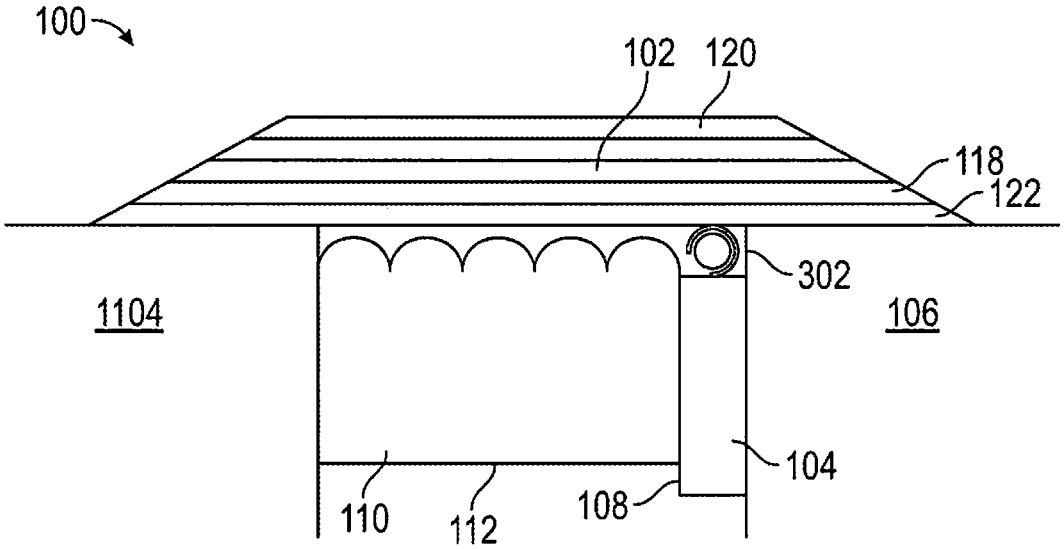
FIG. 3 provides an end view of an embodiment of the present disclosure wherein the rail is rotatably attached to the cover plate.

Referring to FIG. 3, an end view of an embodiment of the present disclosure wherein the rail 104 is rotatably attached to the cover plate 102, such as by a hinge or socket 302. A hinge or socket 302, or similar device, may permit rotation of the cover plate with respect to the rail 104 due to any movement of the cover plate 102 or the first substrate 106 relative to the second substrate 1104. Rotatable attachment permits the cover plate 102 to rotate with respect to the interior planes of the substrates, such as if the substrate 106 moves upward or downward relative to another substrate.

Figure 4:
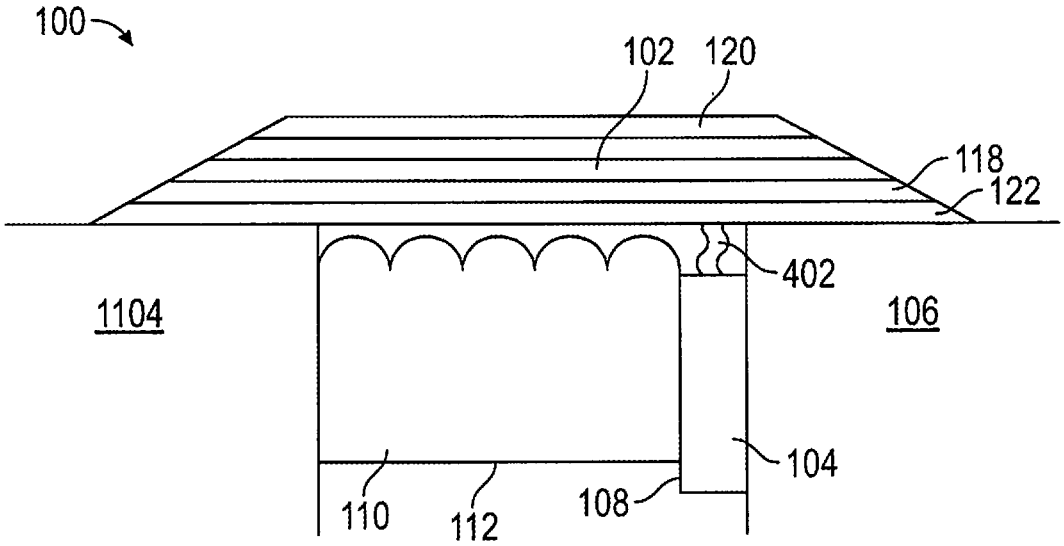
FIG. 4 provides an end view of an embodiment of the present disclosure wherein the rail is tethered to the cover plate.

Referring to FIG. 4, an end view of an embodiment of the present disclosure, the rail 104 may be tethered to the cover plate 102. The rail 104 may therefore further include a tether 402, where the cover plate 102 may be tethered by a tether 402 to the rail 104 to permit movement of the cover plate 102 relative to the rail 104.

Figure 5:
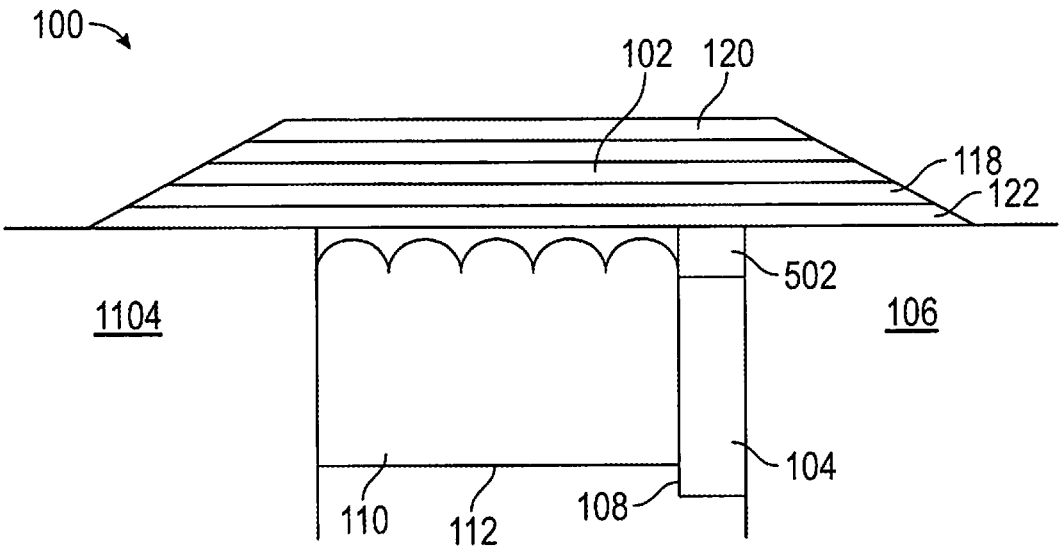
FIG. 5 provides an end view of an embodiment of the present disclosure wherein the rail includes a flexible member for attachment to the cover plate.

Referring to FIG. 5, an end view is provided of an embodiment of the present disclosure wherein the rail 104 includes a flexible member 502 at the rail top surface 124 for attachment to the cover plate 102. The cover plate 102 is therefore rotatably attached to the rail 104 at the flexible member 502.

Figure 6:
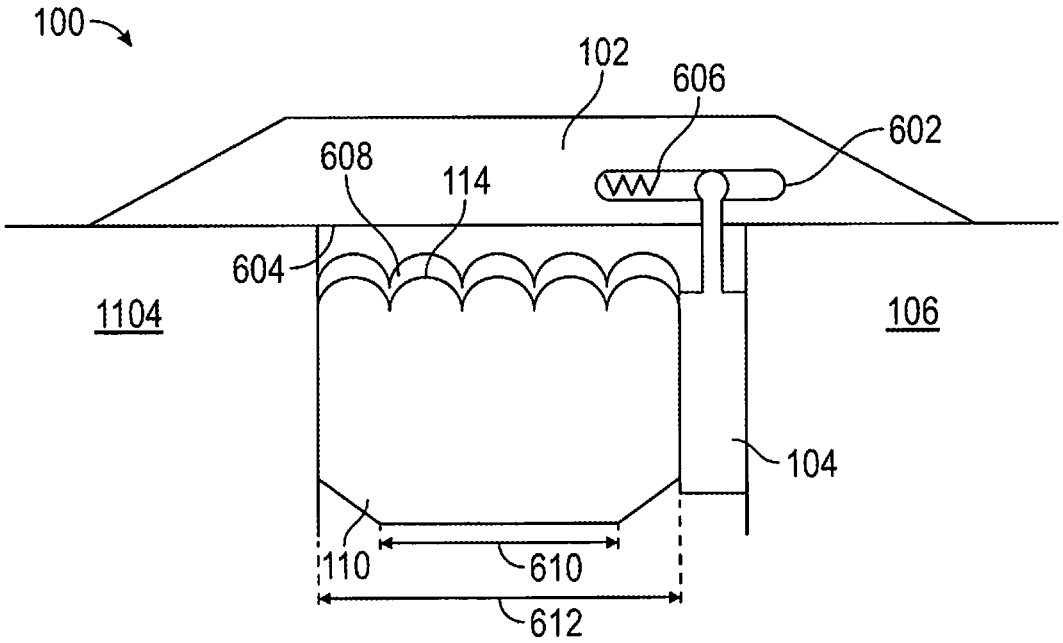
FIG. 6 provides an end view of an alternative embodiment of the present disclosure wherein the rail is connected to the cover plate and stabilized in position.

Referring to FIG. 6, an end view of an alternative embodiment of the present disclosure is provided wherein the rail 104 is connected to the cover plate 102 and stabilized in position. The cover plate 102 may include an enclosed elliptical slot 602 in a cover plate bottom 604 where the rail 104 may be attached to the cover plate 102 by being retained, moveable, in the closed elliptical slot 602. The enclosed elliptical slot 602 permits movement of the cover plate 102 in the direction of impact and allows for access to the expansion joint seal system 100 with the rail 104 attached to the cover plate 102.

The opening 610 in the bottom 604 of the cover plate 102, which provides communication to the closed elliptical slot 602, may be sized to permit and to limit lateral movement of the rail 104 with respect to the cover plate 102. The extent of movement may be limited by boundaries imposed from the top of the cover plate 102, such as by a screw or insert.

To maintain the rail 104 in position, a force-dissipating device 606 may be provided at an end of the enclosed elliptical slot 602. The force-dissipating device 606 may be a spring or shock absorber, positioned at an end of the enclosed elliptical slot 602 to reduce the force transferred from the cover plate 102 and therefore to the elastically-compressible core 110.

An elastomer 608 may be applied at the elastically-compressible core top 114 or may be adhered to the elastically-compressible core 110.

Figure 7:
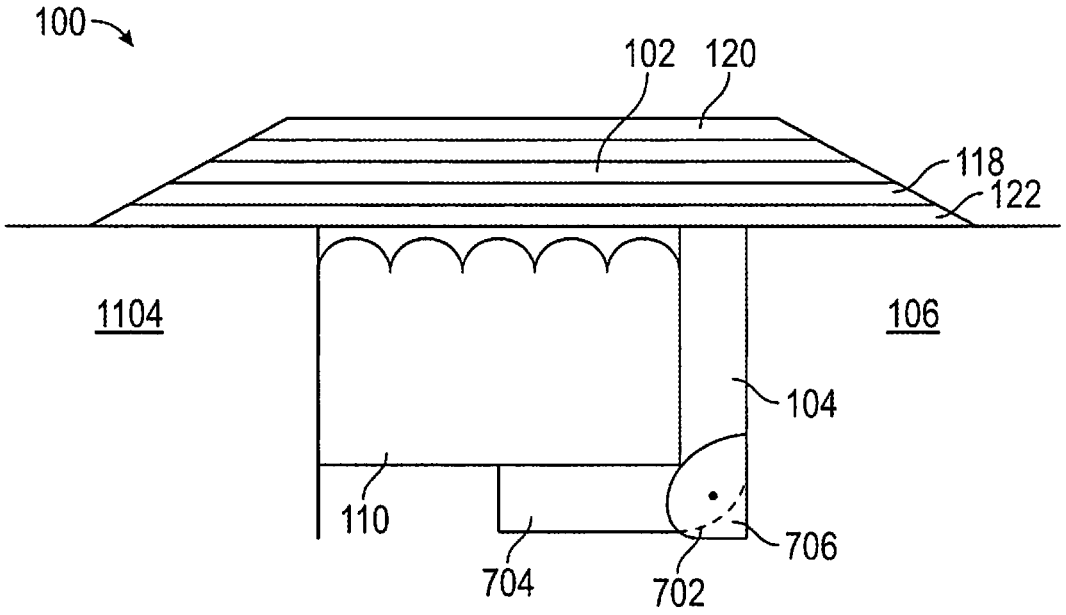
FIG. 7 provides an end view of an alternative embodiment of the present disclosure wherein the rail is hingedly attached to the substrate and which may include a lateral member.

Referring to. FIG. 7, an end view of an alternative embodiment of the present disclosure wherein the rail is hingedly attached to the substrate and which may include a lower member 704 laterally extending from the rail 104 near a rail lower end 702, which extends towards the elastically-compressible core 110. The lower member 704 may provide support to the elastically-compressible core 110 from below. The rail 104 may be rotatably attached by a hinge 706 to the substrate 106 adjacent a rail top end 124 or a rail lower end 702. Beneficially, hinged attachment permits the transfer of loading to the elastically-compressible core 110.

Figure 8:
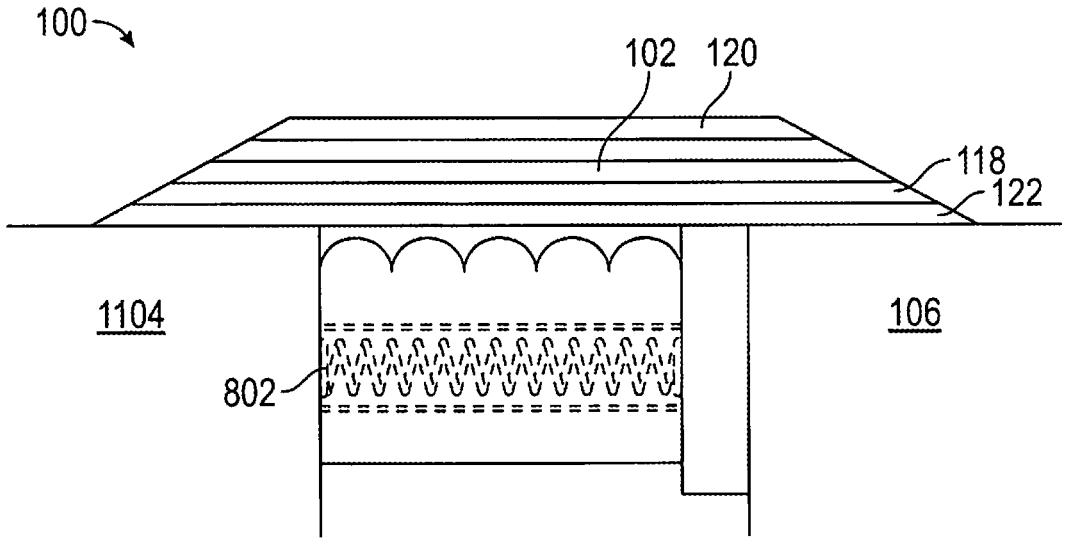
FIG. 8 provides an end view of an embodiment of the present disclosure including a stabilizing spring through the core.

Referring to FIG. 8, an end view of an embodiment of the present disclosure including a stabilizing spring 802 through the elastically-compressible core 110 is provided. The spring 802 may be connected to the rail 104 and aid in stabilizing the rail 104 and in maintaining the elastically-compressible core 110 at maximum movement in response to movement of the substrates 106, 1104. The spring 802 is thus within the elastically-compressible core 110 intermediate an elastically-compressible core first end 116 and an elastically-compressible core second end 126. While the spring 802 may be driven through the compressible core 110, it may be positioned within elastically-compressible core 110 within a sleeve 804 to reduce the contact with the elastically-compressible core 110 and impart more force to the rail 104, avoiding ripping of the elastically-compressible core 110.

Figure 9:
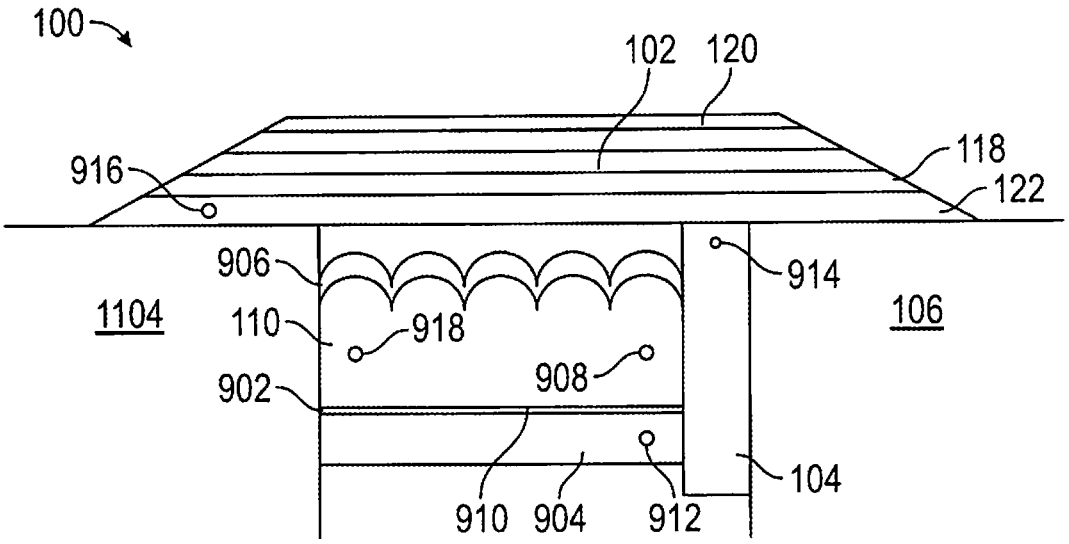
FIG. 9 provides an end view of an embodiment of the present disclosure including a membrane.

Referring to FIG. 9, an end view of an embodiment of the present disclosure which includes a membrane 902. Preferably, the membrane 902 is positioned below the elastically-compressible core 110 at the elastically-compressible core bottom surface 112.

The membrane 902 extends across the elastically-compressible core 110 but need not reach the elastically compressible core first side 116 and need not reach the elastically compressible core second side 126. Alternatively, the membrane 902 may extend to each of the elastically compressible core first side 116 and the elastically compressible core second side 126 or may extend beyond the elastically compressible core first side 116 and the elastically compressible core second side 126 to provide an area of increased density in each elastically-compressible core 110 and/or to provide a surface for adhesion to the first substrate 106 and the rail 104. Selective injection/infusion or a functional membrane is particularly beneficial in providing dimensional support and stability. This may be a polymer that cures or thermosets at temperatures between 150-500° F. and which is flexible until the exposure to a high temperature event. Due to the selective placement in the elastically-compressible core 110, the polymer does not provide a potential fuel source and can be placed where it will cure within the elastically-compressible core 110 in a fire event, such that it will not burn but will instead be heated to its reaction temperature, cure and provide a rigid structural support for the remainder of the elastically-compressible core 110.

When desired, a second elastically-compressible core 904 may be positioned below the membrane 902, either in contact with the membrane 902, or adjacent or near, but spaced apart from, it to create an insulating air pocket or gap intermediate the second elastically-compressible core 904 and the elastically-compressible core 110. The second elastically-compressible core 904 may be impregnated with a fire-retardant material or may otherwise have or be modified to have fire retardant properties. When the membrane 902 is not present, the second elastically-compressible core 904 may be positioned below the elastically-compressible core 110. Further, when desired, a top membrane 906 may be positioned atop the elastically-compressible core 110 at the elastically-compressible core top surface 920 or above the elastically-compressible core 110. The top membrane 906 may be coated with an elastomer. One of more of the membranes 902, 906 may be an extruded gland and may provide a springing-force profile.

Additionally, when desired, a sensor 908, 910, 912, 914, 916 may be included and may contact one of more of the cover plate 102, the rail 104, the elastically-compressible core 110, the membrane 902, the top membrane 906, or the second elastically-compressible core 904. The sensor 908, 912, 914, 916 may be a radio frequency identification device (RFID) or other wirelessly transmitting sensor. A sensor 908, 910, 912, 914, 916 may be beneficial to assess the health of a system 100 without accessing the interior of the expansion joint, otherwise accomplished by removal of the cover plate. Such sensors 908, 910, 912, 914, 916, are known in the art, and which may provide identification of circumstances such as moisture penetration and accumulation. The inclusion of a sensor 908, 910, 912, 914, 916 in the expansion joint seal system 100 may be particularly advantageous in circumstances where the expansion joint seal system 100 is concealed after installation, particularly as moisture sources and penetration may not be visually detected. Thus, by including a low cost, moisture-activated or sensitive sensor 908, 910, 912, 914, 916 at the core bottom surface 112, the user can scan the expansion joint seal system 100 for any points of weakness due to water penetration. A heat sensitive sensor 908, 910, 912, 914, 916 may also be positioned within the expansion joint seal system 100, particularly on or in the elastically-compressible core 110, thus permitting identification of actual internal temperature, or identification of temperature conditions requiring attention, such as increased temperature due to the presence of fire, external to the joint or even behind it, such as within a wall. Such data may be particularly beneficial in roof and below grade installations where water penetration is to be detected as soon as possible.

Inclusion of a sensor 908, 910, 912, 914, 916 may provide substantial benefit for information feedback and potentially activating alarms or other functions within the joint sealant or external systems. Fires that start in curtain walls are catastrophic. High and low-pressure changes have deleterious effects on the long-term structure and the connecting features. Providing real time feedback and potential for data collection from sensors, particularly given the inexpensive cost of such sensors, in those areas and particularly where the wind, rain and pressure will have their greatest impact would provide benefit. While the pressure on the wall is difficult to measure, for example, the deflection in a precompressed sealant is quite rapid and linear. Additionally, joint seals are used in interior structures including but not limited to bio-safety and cleanrooms. The rail 102 may be selected of a heat-conducting material and positioned in communication with the sensor 908, 910, 912, 914, 916. Additionally, a sensor 908, 910, 912, 914, 916 could be selected which would provide details pertinent to the state of the Leadership in Energy and Environmental Design (LEED) efficiency of the building. Additionally, such a sensor 908, 910, 912, 914, 916, which could identify and transmit air pressure differential data, could be used in connection with masonry wall designs that have cavity walls or in the curtain wall application, where the air pressure differential inside the cavity wall or behind the cavity wall is critical to maintaining the function of the system. A sensor 908, 910, 912, 914, 916 may be positioned in other locations within the expansion joint seal system 100 to provide beneficial data. A sensor 908, 910, 912, 914, 916 may be positioned within the elastically-compressible core 110 at, or near, the core top surface 114 to provide prompt notice of detection of heat outside typical operating parameters, so as to indicate potential fire or safety issues. Such a positioning would be advantageous in horizontal of confined areas. A sensor 908, 910, 912, 914, 916 so positioned might alternatively be selected to provide moisture penetration data, beneficial in cases of failure or conditions beyond design parameters. The sensor 908, 910, 912, 914, 916 may provide data on moisture content, heat or temperature, moisture penetration, and manufacturing details. A sensor 908, 910, 912, 914, 916 may provide notice of exposure from the surface of the expansion joint seal system 100 most distant from the base of the joint. A sensor 908, 910, 912, 914, 916 may further provide real time data. Using a moisture sensitive sensor 908, 910, 912, 914, 916 in the expansion joint seal system 100 and at critical junctions/connections would allow for active feedback on the waterproofing performance of the expansion joint seal system 100. It can also allow for routine verification of the watertightness with a hand-held sensor reader to find leaks before the reach occupied space and to find the source of an existing leak. Often water appears in a location much different than it originates making it difficult to isolate the area causing the leak. A positive reading from the sensor alerts the property owner to the exact location(s) that have water penetration without or before destructive means of finding the source. The use of a sensor 908, 910, 912, 914, 916 in the expansion joint seal system 100 is not limited to identifying water intrusion but also fire, heat loss, air loss, break in joint continuity and other functions that cannot be checked by non-destructive means. Use of a sensor 908, 910, 912, 914, 916 within the elastically-compressible core 110 may provide a benefit over the prior art. Impregnated foam materials, which may be used for the elastically-compressible core 110, are known to cure fastest at exposed surfaces, encapsulating moisture remaining inside the body, and creating difficulties in permitting the removal of moisture from within the body. While heating is a known method to addressing these differences in the natural rate of cooling, it unfortunately may cause degradation of the foam in response. Similarly, while forcing air through the foam bodies may be used to address the curing issues, the potential random cell size and structure impedes airflow and impedes predictable results. Addressing the variation in curing is desirable as variations affect quality and performance properties. The use of a sensor 908, 910, 912, 914, 916 within the body may permit use of the heating method while minimizing negative effects. The data from the sensors, such as real-time feedback from the heat, moisture and air pressure sensors, aids in production of a consistent product. Moisture and heat sensitive sensors aid in determining and/or maintaining optimal impregnation densities, airflow properties of the foam during the curing cycle of the foam impregnation. Placement of the sensors into foam at the pre-determined different levels allows for optimum curing allowing for real time changes to temperature, speed and airflow resulting in increased production rates, product quality and traceability of the input variables to that are used to accommodate environmental and raw material changes for each product lots.

Further, when desired, an intumescent body 918 may be positioned within or contact the elastically compressible core 110, providing potential fire resistant when needed.

Figure 10:
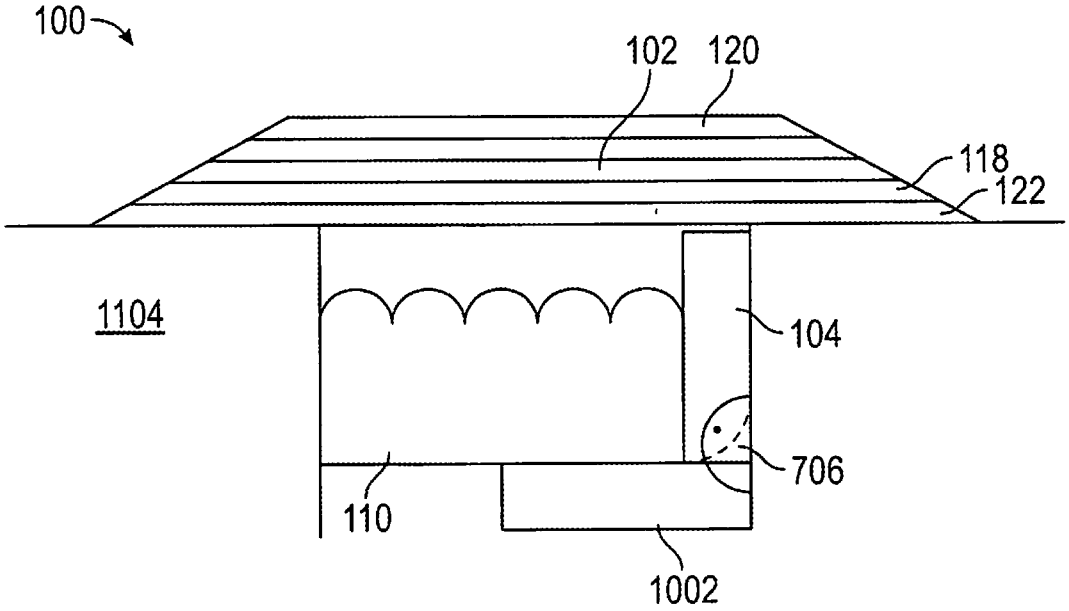
FIG. 10 provides an end view of an alternative embodiment of the present disclosure wherein the rail is hingedly attached to the substrate and wherein the lateral member is fixed in position.

Referring to FIG. 10, an end view is provided of an alternative embodiment of the present disclosure wherein the rail 104 is hingedly attached to the substrate 106 by a hinge 706 and wherein the lateral member 1002 is fixed in position to the substrate 106 below the rail 104, which may be by attachment to the substrate 106 or to the hinge 706. The lateral member 1002 may extend laterally beyond the rail first side 108 below the elastically-compressible core 102. The lateral member 1002 may provide support to the elastically-compressible core 110 from below.

Figure 11:
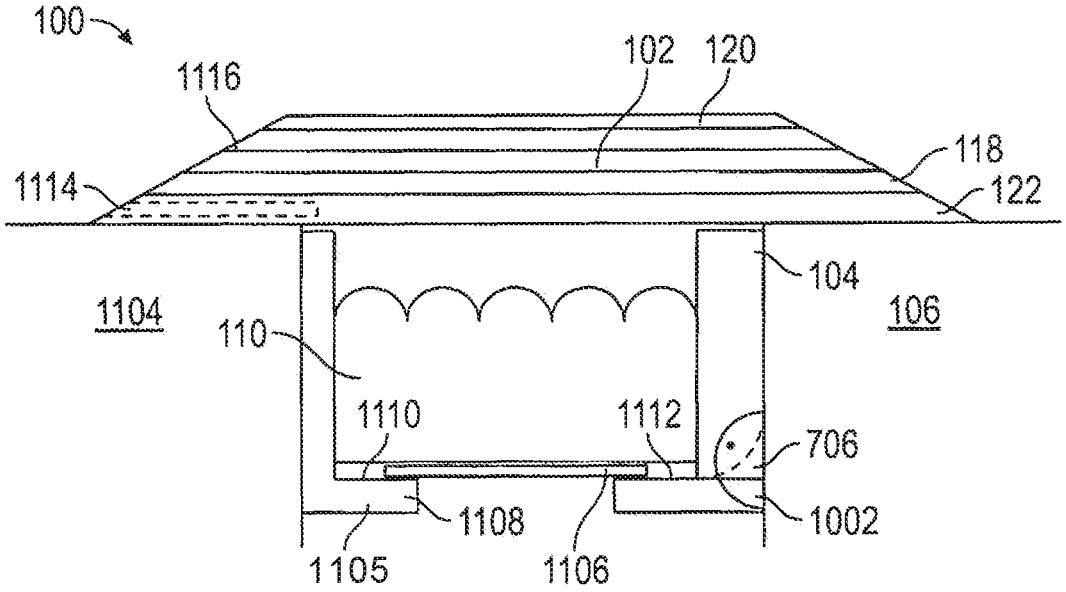
FIG. 11 provides an end view of an alternative embodiment of the present disclosure wherein a second rail is provided.

Referring to FIG. 11, an end view is provided of an alternative embodiment of the present disclosure wherein a second rail 1105 is provided. The second rail 1105 may be attached to a second substrate 1104 and may provide a second rail lateral member 1108 extending toward to the substrate 106. The second rail lateral member 1108 may provide support to the elastically-compressible core 110 from below. A floating plate 1106 has a width sufficient to span the distance between the lateral member 1002 and the second rail lateral member 1108 at the maximum movement of the expansion joint seal system 100, while being sufficiently narrow that it does not interfere with the expansion joint seal system 100 at the maximum compression. The floating plate 1106 may likewise provide support to the elastically-compressible core 110 from below. The cover plate 102 may include a tool receiver 1114 in a cover plate first side 1116 to facilitate access. The floating plate 1106 may contact a second rail top surface 1110 of the second rail and a lateral member top surface 1112 of the lateral member 1002.

Figure 12:
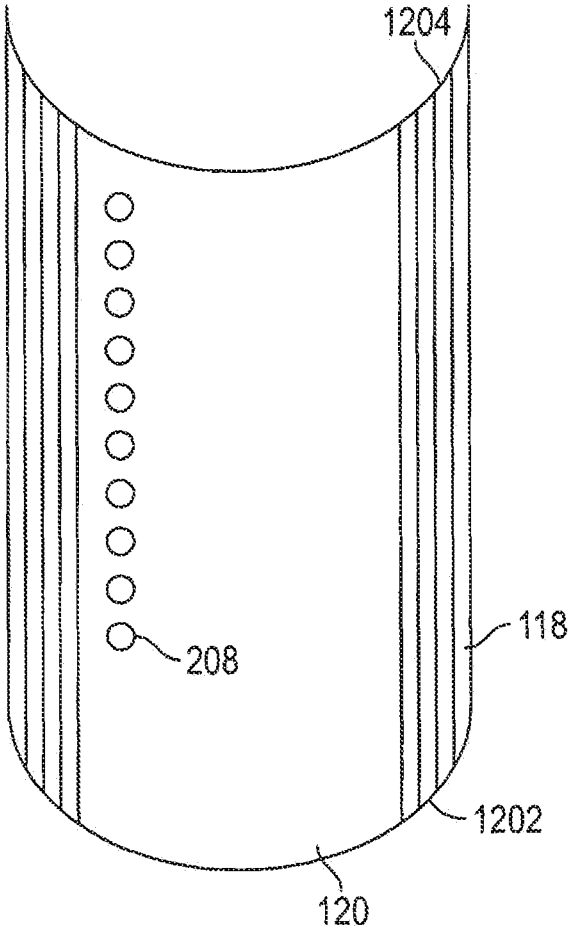
FIG. 12 provides a top view of a cover plate of one embodiment of the present disclosure with ends intended use in non-linear joints.

Referring to FIG. 12, a top view is provided of a cover plate 102 of one embodiment of the present disclosure with ends intended for use in non-linear joints. The cover plate 102 may have a rounded first end 1202 or a second complementary rounded second 1204, so a plurality of systems 100 can be positioned adjacent and may utilize a common elastically-compressible core 110, permitting a positioning in a non-linear joint. Similarly, rather than having conically constructed ends, the cover plate 102 may be non-rectangular, such as a parallelogram or regular trapezoid, so that any flexing will simply cause rotation of the cover plate 102 in the expansion joint seal system 100. Any such rotation will be impeded, resisted and potentially reversed, by the internal forces of the expansion joint seal system 100 after the external force is removed. Similarly, a cover plate 102 of shorter length may further reduce the likelihood of failure in response to external forces. In such cases, the expansion joint seal system 100 continues functioning, and continues to deter debris, water, and fire from entry into the expansion joint.

Figure 13:
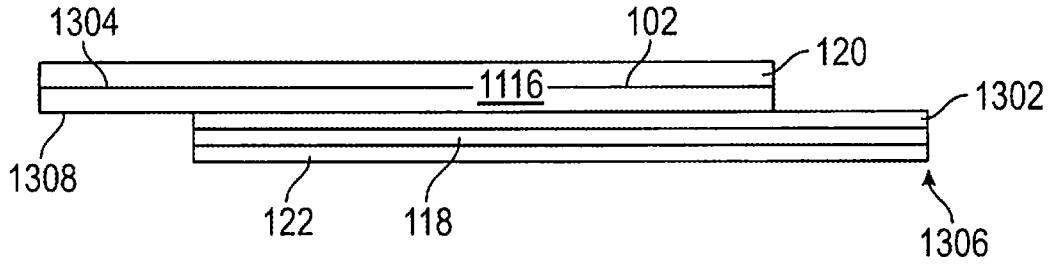
FIG. 13 provides a side view of a cover plate of one embodiment of the present disclosure with interlocking ends.

Referring to FIG. 13, a side view is provided of a cover plate 102 of one embodiment of the present disclosure with interlocking ends. The cover plate 102 may have a tab 1302 ending from bottom of the cover plate first end 1306 and may have a corresponding receiver 1304 at the cover plate second end 1308, so two cover plates 102 may be interlocked, affording use of shorter cover plates 102, beneficial in addressing any surface irregularities or in adjusting length. The cover plate 102 thus provides a first mating surface with the tab 1302 at a cover plate first end 1306 and a corresponding mating surface with the receiver 1304 at a cover plate second end 1308.

Figure 14:
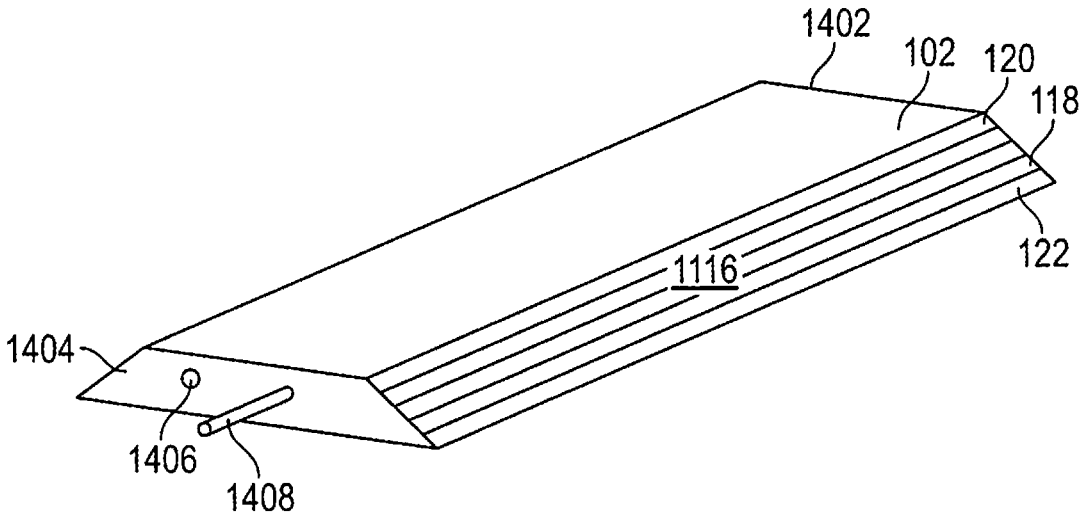
FIG. 14 provides an isometric view of a cover plate of one embodiment of the present disclosure with pins for interlocking.

Referring to FIG. 14, an isometric view is provided of a cover plate 102 of one embodiment of the present disclosure with pins 1408 for interlocking. The cover plate 102 may have cylindrical openings 1406 at each of the cover plate first end 1402 and at the cover plate second end 1404, and the expansion joint seal system 100 may include cylindrical pins 1408 to permit the cover plates 102 to be joined together. Alternative, a capture mechanism at a cover plate first end 1402 and a capture component at a cover plate second end 1308 to retain a plurality of cover plates 102 in relative position to one another.

Figure 15:
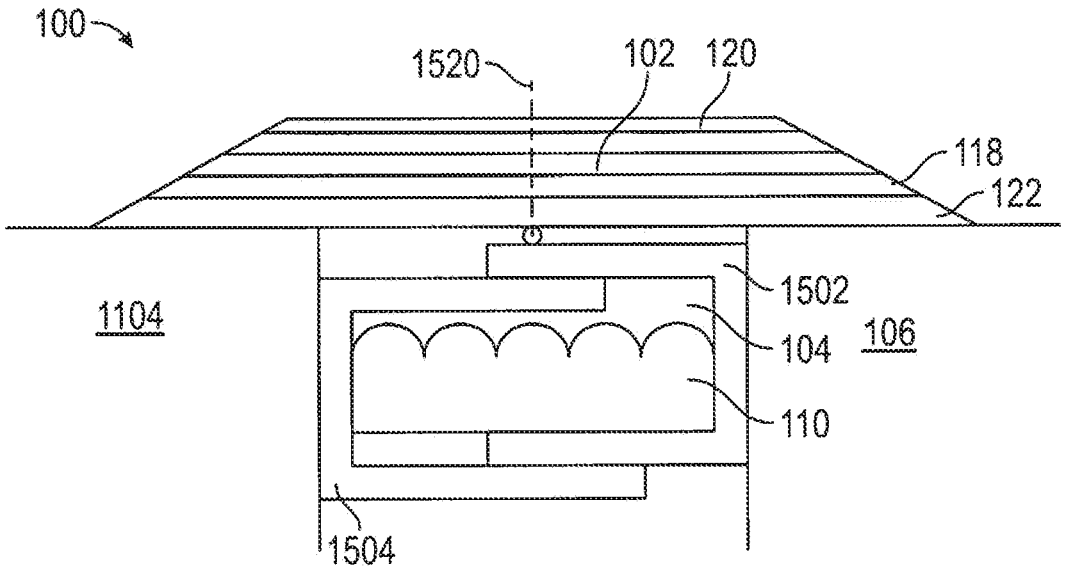
FIG. 15 provides an end view of an embodiment of the present disclosure wherein a second rail is provided and the cover plate is connected near its midline to the rail.

Referring to FIG. 15, an end view is provided of an embodiment of the present disclosure wherein a second rail 1504 is provided and the cover plate 102 is connected near its midline 1520 to the rail 104. Thus, the point of connection of the rail 104 to the cover plate 102 may be directly above the rail 104 or may be elsewhere. The rail 104 may have an upper lateral member or upper web 1502, having an inverted L or a C-shape, which may be attached to the cover plate 102. This allows shallow depth foam, and when a C-shape prevents shifting of the elastically-compressible core 110. A C-shape further provides support to the elastically-compressible core 110 from below. When used, the upper lateral member 1502 provides protection to the elastically-compressible core 110 and can provide support and centering to the cover plate 102. Additionally, when desired, a second rail 1504 having a C-shape may be affixed to the second substrate 1104 and may overlap any lateral member 1002 to produce an overlap of the rails and to provide some protection to the elastically-compressible core 110. The overlap may provide +/−50% movement without interference. A system 100 incorporating the rail 104 and the second rail 1504 having a C-shape may be packaged while the elastically-compressible core 110 is compressed for a pre-compressed installation regime. Further, the second rail 1504 may be attached to the cover plate 102. A common cover plate 100 may be used across a plurality of systems 100, where the attachment of the first rail 104 to the common cover plate 102 in a first system 100 is followed by the attachment of second rail 1504 to the common cover plate 102 in a second system 100, followed by successive alternative attachments.

Figure 16:
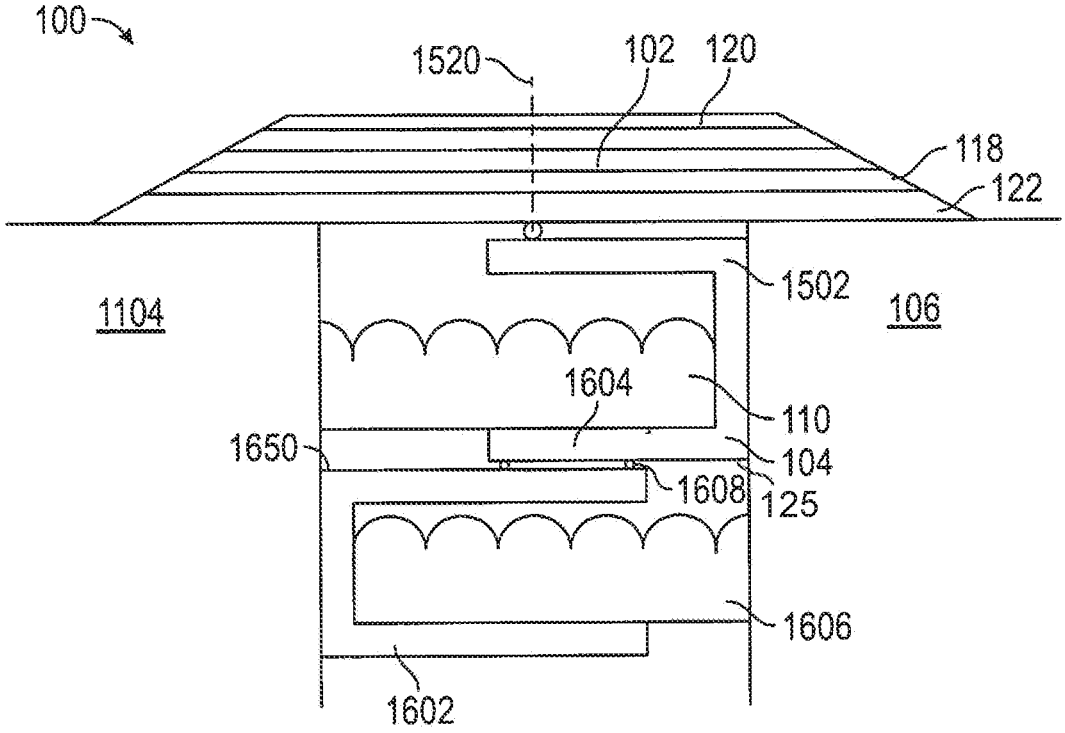
FIG. 16 provides an end view of an embodiment of the present disclosure wherein the cover plate is connected near its midline to the rail and wherein a second rail is provided below the rail.

Referring to FIG. 16, an end view is provided of an embodiment of the present disclosure wherein the cover plate 102 is connected near the cover plate midline 1520 to the rail 104 and wherein a second rail 1602 is provided below the rail 104. A second rail 1602 having a C-shape may be attached to the lateral member 1604 of a rail 104 wherein an elastically-compressible core 110 is positioned on the lateral member 1604, and a second elastically-compressible core 1606 is position within the second rail 1602. The connection 1608 may be a simple tether, a bolt connection, a slidable connection, or other system. The upper surface 1650 of the second rail 1602 may contact the bottom surface 125 of the rail 104. Where desired, one of the elastically-compressible core 110 and the second elastically-compressible core 1606 is water resistant and the other is fire resistant, providing water resistance and fire resistance while isolating the various properties from one another and from traffic and wear.

The selection of components providing resiliency, compressibility, water-resistance and fire resistance, the expansion joint seal system 100 may be constructed to provide sufficient characteristics to obtain fire certification under any of the many standards available. In the United States, these include ASTM International's E 814 and its parallel Underwriter Laboratories UL 1479 "Fire Tests of Through-penetration Firestops," ASTM International's E1966 and its parallel Underwriter Laboratories UL 2079 "Tests for Fire-Resistance Joint Systems," ASTM International's E 2307 "Standard Test Method for Determining Fire Resistance of Perimeter Fire Barrier Systems Using Intermediate-Scale, Multi-story Test Apparatus, the tests known as ASTM E 84, UL 723 and NFPA 255 "Surface Burning Characteristics of Building Materials," ASTM E 90 "Standard Practice for Use of Sealants in Acoustical Applications," ASTM E 119 and its parallel UL 263 "Fire Tests of Building Construction and Materials," ASTM E 136 "Behavior of Materials in a Vertical Tube Furnace at 750° C." (Combustibility), ASTM E 1399 "Tests for Cyclic Movement of Joints," ASTM E 595 "Tests for Outgassing in a Vacuum Environment," ASTM G 21 "Determining Resistance of Synthetic Polymeric Materials to Fungi." Some of these test standards are used in particular applications where firestop is to be installed.

Most of these use the Cellulosic time/temperature curve, described by the known equation T=20+345*LOG(8*t+1) where t is time, in minutes, and T is temperature in degrees Celsius including E 814/UL 1479 and E 1966/UL 2079.

E 814/UL 1479 tests a fire retardant system for fire exposure, temperature change, and resilience and structural integrity after fire exposure (the latter is generally identified as "the Hose Stream test"). Fire exposure, resulting in an F [Time] rating, identifies the time duration—rounded down to the last completed hour, along the Cellulosic curve before flame penetrates through the body of the system, provided the system also passes the hose stream test. Common F ratings include 1, 2, 3 and 4 hours Temperature change, resulting in a T [Time] rating, identifies the time for the temperature of the unexposed surface of the system, or any penetrating object, to rise 181° C. above its initial temperature, as measured at the beginning of the test. The rating is intended to represent how long it will take before a combustible item on the non-fireside will catch on fire from heat transfer. In order for a system to obtain a UL 1479 listing, it must pass both the fire endurance (F rating) and the Hose Stream test. The temperature data is only relevant where building codes require the T to equal the F-rating.

When required, the Hose Steam test is performed after the fire exposure test is completed. In some tests, such as UL 2079, the Hose Stream test is required with wall-to-wall and head-of-wall joints, but not others. This test assesses structural stability following fire exposure as fire exposure may affect air pressure and debris striking the fire resistant system. The Hose Stream uses a stream of water. The stream is to be delivered through a 64 mm hose and discharged through a National Standard playpipe of corresponding size equipped with a 29 mm discharge tip of the standard-taper, smooth-bore pattern without a shoulder at the orifice consistent with a fixed set of requirements:

| Hourly Fire Rating Time in Minutes | Water Pressure (kPa) | Duration of Hose Stream Test (sec./m$^2$) |
|---|---|---|
| 240 ≤ time < 480 | 310 | 32 |
| 120 ≤ time < 240 | 210 | 16 |
| 90 ≤ time < 120 | 210 | 9.7 |
| time < 90 | 210 | 6.5 |

The nozzle orifice is to be 6.1 m from the center of the exposed surface of the joint system if the nozzle is so located that, when directed at the center, its axis is normal to the surface of the joint system. If the nozzle is unable to be so located, it shall be on a line deviating not more than 30° from the line normal to the center of the joint system. When so located its distance from the center of the joint system is to be less than 6.1 m by an amount equal to 305 mm for each 10° of deviation from the normal. Some test systems, including UL 1479 and UL 2079 also provide for air leakage and water leakage tests, where the rating is made in conjunction with a L and W standard. These further ratings, while optional, are intended to better identify the performance of the system under fire conditions.

When desired, the Air Leakage Test, which produces an L rating and which represents the measure of air leakage through a system prior to fire endurance testing, may be conducted. The L rating is not pass/fail, but rather merely a system property. For Leakage Rating test, air movement through the system at ambient temperature is measured. A second measurement is made after the air temperature in the chamber is increased so that it reaches 177° C. within 15 minutes and 204° C. within 30 minutes. When stabilized at the prescribed air temperature of 204±5° C., the air flow through the air flow metering system and the test pressure difference are to be measured and recorded. The barometric pressure, temperature and relative humidity of the supply air are also measured and recorded. The air supply flow values are corrected to standard temperature and pressure (STP) conditions for calculation and reporting purposes. The air leakage through the joint system at each temperature exposure is then expressed as the difference between the total metered air flow and the extraneous chamber leakage. The air leakage rate through the joint system is the quotient of the air leakage divided by the overall length of the joint system in the test assembly.

When desired, the Water Leakage Test produces a W pass-fail rating and which represents an assessment of the watertightness of the system, can be conducted. The test chamber for or the test consists of a well-sealed vessel sufficient to maintain pressure with one open side against which the system is sealed and wherein water can be placed in the container. Since the system will be placed in the test container, its width must be equal to or greater than the exposed length of the system. For the test, the test fixture is within a range of 10 to 32° C. and chamber is sealed to the test sample. Nonhardening mastic compounds, pressure-sensitive tape or rubber gaskets with clamping devices may be used to seal the water leakage test chamber to the test assembly. Thereafter, water, with a permanent dye, is placed in the water leakage test chamber sufficient to cover the systems to a minimum depth of 152 mm. The top of the joint system is sealed by whatever means necessary when the top of the joint system is immersed under water and to prevent passage of water into the joint system. The minimum pressure within the water leakage test chamber shall be 1.3 psi applied for a minimum of 72 hours. The pressure head is measured at the horizontal plane at the top of the water seal. When the test method requires a pressure head greater than that provided by the water inside the water leakage test chamber, the water leakage test chamber is pressurized using pneumatic or hydrostatic pressure. Below the system, a white indicating medium is placed immediately below the system. The leakage of water through the system is denoted by the presence of water or dye on the indicating media or on the underside of the test sample. The system passes if the dyed water does not contact the white medium or the underside of the system during the 72-hour assessment.

Another frequently encountered classification is ASTM E-84 (also found as UL 723 and NFPA 255), Surface Burning Characteristics of Burning Materials. A surface burn test identifies the flame spread and smoke development within the classification system. The lower a rating classification, the better fire protection afforded by the system. These classifications are determined as follows:

| Classification | Flame Spread | Smoke Development |
|---|---|---|
| A | 0-25 | 0-450 |
| B | 26-75 | 0-450 |
| C | 76-200 | 0-450 |

UL 2079, Tests for Fire Resistant of Building Joint Systems, comprises a series of tests for assessment for fire resistive building joint system that do not contain other unprotected openings, such as windows and incorporates four different cycling test standards, a fire endurance test for the system, the Hose Stream test for certain systems and the optional air leakage and water leakage tests. This standard is used to evaluate floor-to-floor, floor-to-wall, wall-to-wall and top-of-wall (head-of-wall) joints for fire-rated construction. As with ASTM E-814, UL 2079 and E-1966 provide, in connection with the fire endurance tests, use of the Cellulosic Curve. UL 2079/E-1966 provides for a rating to the assembly, rather than the convention F and T ratings. Before being subject to the Fire Endurance Test, the same as provided above, the system is subjected to its intended range of movement, which may be none. These classifications are:

| Movement Classification (if used) | Minimum number of cycles | Minimum cycling rate (cycles per minute) | Joint Type (if used) |
|---|---|---|---|
| No Classification | 0 | 0 | Static |
| Class I | 500 | 1 | Thermal Expansion/Contraction |
| Class II | 500 | 10 | Wind Sway |
| Class III | 100 | 30 | Seismic |
| | 400 | 10 | Combination |

ASTM E 2307, Standard Test Method for Determining Fire Resistance of Perimeter Fire Barrier Systems Using Intermediate-Scale, Multi-story Test Apparatus, is intended to test for a systems ability to impede vertical spread of fire from a floor of origin to that above through the perimeter joint, the joint installed between the exterior wall assembly and the floor assembly. A two-story test structure is used wherein the perimeter joint and wall assembly are exposed to an interior compartment fire and a flame plume from an exterior burner. Test results are generated in F-rating and T-rating. Cycling of the joint may be tested prior to the fire endurance test and an Air Leakage test may also be incorporated.

The expansion joint seal system 100 may therefore perform wherein the core bottom surface 112 at a maximum joint width increases no more than 181° C. after sixty minutes when the elastically-compressible core 110 is exposed to heating according to the equation T=20+345*LOG(8*t+1), where t may be time in minutes and T may be temperature in C.

The expansion joint seal system 100 may also perform wherein the core bottom surface (112) of the elastically-compressible core 110, having a maximum joint width of more than six (6) inches, increases no more than 139° C. after sixty minutes when the expansion joint seal system 100 is exposed to heating according to the equation T=20+345*LOG(8*t+), where t may be time in minutes and T may be temperature in C.

The elastically-compressible core 110 may be adapted to be cycled one of 500 times at 1 cycle per minute, 500 times at 10 cycles per minute and 100 cycles at 30 times per minute, without indication of stress, deformation or fatigue.

The expansion joint seal system 100 may be supplied in individual components or may be supplied in a constructed state so that it may installed in an economical one step operation yet perform like more complicated multipart systems. The cover plate 102 can be solid continuous or be smaller segments to support the elastic-compressible core 110. The use of smaller cover plates 102 to provide dimensional and/or compression support is beneficial in wide and shallow depth applications where products in the art will not work. The entire expansion joint seal system 100 may be constructed such that a gap is present between the cover plate 102 and the elastically-compressible core 110 and a retaining band positioned about the elastically-compressible core 110 to maintain compression during shipping and before installation without additional spacers that would limit test fitting of the expansion joint seal system 100 prior to releasing the elastically-compressible core 110 from factory compression. Packaging materials, that increase the bulk and weight of the product for shipping and handling to and at the point of installation, are therefore also eliminated.

The foregoing disclosure and description is illustrative and explanatory thereof. Various changes in the details of the illustrated construction may be made within the scope of the appended claims without departing from the spirit of the invention. The present invention should only be limited by the following claims and their legal equivalents.

I claim:

1. An expansion joint seal, comprising a cover plate;

a vertically-oriented elongate rail adapted for attachment to a vertically-oriented exposed surface of an immediately adjacent substrate at a rail vertically-oriented second side, the vertically-oriented elongate rail having a rail vertically-oriented first side opposite the rail vertically-oriented second side;

an elastically-compressible core having a core bottom surface, a core top surface and a core first side;

the vertically-oriented elongate rail having at a rail top surface for impermanent attachment to the cover plate by a connecting member selected from the group including a hinge, a tether and a flexible member;

the vertically-oriented elongate rail having a profile selected from the group of a vertical bar, a c-shaped open channel, and an L-shaped channel, the c-shaped open channel having an upper lateral member extending from the rail vertically-oriented first side and a lower lateral member extending from the rail vertically-oriented first side, and the L-shaped channel having a lateral member extending from the rail vertically-oriented first side;

and the elastically-compressible core adapted at the core first side to contact the vertically-oriented elongate rail at the rail vertically-oriented first side.

2. The expansion joint seal of claim 1, further comprising the cover plate is rotatably attached to the vertically-oriented elongate rail.

3. The expansion joint seal of claim 1, further comprising the cover plate having a first mating surface at a cover plate first end and a corresponding mating surface at a cover plate second end.

4. The expansion joint seal of claim 1, wherein the vertically-oriented elongate rail is composed in part of one of a hydrophilic material, a hydrophobic material, a fire-retardant material, an electrically conductive material, a carbon fiber material, and an intumescent material.

5. The expansion joint seal of claim 1, wherein the vertically-oriented elongate rail is adapted for attachment to the substrate.

6. The expansion joint seal of claim 1, wherein the vertical bar further comprises:

a lower member laterally extending from the vertically-oriented elongate rail near a rail lower end, the rail lower end opposite the rail top surface.

7. The expansion joint seal of claim 1, wherein the vertically-oriented elongate rail is attached near a midline of the cover plate.

8. The expansion joint seal of claim 1, wherein the elastically-compressible core is a foam and includes an impregnation selected from the group of a fire retardant and a water inhibitor.

9. The expansion joint seal of claim 1, wherein the elastically-compressible core is composed of one of a hydrophilic material, a hydrophobic material, a fire-retardant material, a sintering material.

10. The expansion joint seal of claim 1, wherein the elastically-compressible core is composed of an open cell foam, a lamination of open cell foam and close cell foam, and closed cell foam.

11. The expansion joint seal of claim 1, further comprising:

a spring within the elastically-compressible core intermediate an elastically-compressible core first end and an elastically-compressible core second end.

12. The expansion joint seal of claim 1, further comprising:

a membrane positioned below the elastically-compressible core at the elastically-compressible core bottom surface.

13. The expansion joint seal of claim 12, further comprising:

a second elastically-compressible core positioned below the membrane.

14. The expansion joint seal of claim 1, further comprising:

a top membrane positioned above the elastically-compressible core at the elastically-compressible core top surface.

15. The expansion joint seal of claim 1 wherein the core bottom surface is adapted at a maximum joint width to increase no more than 181° C. after sixty minutes when the elastically-compressible core is exposed to heating according to the equation T=20+345*LOG(8*t+1), where t is time in minutes and T is temperature in C.

16. The expansion joint seal of claim 1 wherein the core bottom surface is adapted to have a temperature increase of no more than 139° C. after sixty minutes when the joint seal is exposed to heating according to the equation T=20+345*LOG(8*t+1), where t is time in minutes and T is temperature in C of the elastically-compressible core, the elastically-compressible core having a maximum joint width of more than six (6) inches.

17. The expansion joint seal of claim 1, further comprising:

a radio frequency identification device contacting with one of the cover plate, the vertially-oriented elongate rail, and the elastically-compressible core.

18. The expansion joint seal of claim 1, wherein the vertical bar further comprises:

a lateral member extending laterally beyond the rail vertically-oriented first side below the elastically-compressible core.

19. The expansion joint seal of claim 1, further comprising:

a second elastically-compressible core positioned below the elastically-compressible core.

20. The expansion joint seal of claim 1, further comprising:

a second rail attached to a second substrate, the second rail having a second rail lateral member extending toward the vertically-orientated elongate rail.

21. The expansion joint seal of claim 20 wherein the vertical bar further comprises:

a lateral member extending laterally beyond the rail vertically-oriented first side below the elastically-compressible core, and a plate contacting a second rail top surface of the second rail and a lateral member top surface of the lateral member.

22. The expansion joint seal of claim 1, further comprising a second rail, wherein an upper surface of the second rail contacts a bottom surface of the vertically-oriented elongate rail.

23. The expansion joint seal of claim 1 wherein vertical bar further comprises the rail top surface intermediate the rail vertically-oriented first side and the rail vertically-oriented second side.

* * * * *